United States Patent [19]

Breton et al.

[11] Patent Number: 5,037,368

[45] Date of Patent: Aug. 6, 1991

[54] FOLDER APPARATUS

[75] Inventors: Richard E. Breton, Rochester, N.H.; David B. Staley, Saundertown, R.I.

[73] Assignee: Harris Graphics Corporation, Dover, N.H.

[21] Appl. No.: 572,130

[22] Filed: Aug. 23, 1990

Related U.S. Application Data

[62] Division of Ser. No. 401,638, Aug. 31, 1989.

[51] Int. Cl.[5] ..... B65H 45/22; B65H 45/30

[52] U.S. Cl. ..... 493/423; 493/399; 493/439; 493/441

[58] Field of Search ..... 493/358, 397, 399, 423, 493/436, 438, 439, 440, 441

[56] References Cited

U.S. PATENT DOCUMENTS

| | | | |
|---|---|---|---|
| 200,838 | 3/1878 | Nordblom et al. | 493/423 |
| 281,619 | 7/1883 | Crowell | 493/439 |
| 351,470 | 10/1886 | Scott | 493/439 |
| 523,499 | 7/1894 | Windle | 493/439 |
| 531,794 | 1/1895 | Goss | 493/439 |
| 1,313,712 | 8/1919 | MacFarland | 493/423 |
| 2,039,335 | 5/1936 | Nall | 493/399 |
| 2,619,057 | 11/1952 | Ellis | 493/439 |
| 3,122,069 | 2/1964 | Lopez | 493/423 |
| 3,127,165 | 3/1964 | St. Denny | 493/423 |
| 3,961,783 | 6/1976 | Beaudoin | 493/423 |
| 4,710,157 | 12/1987 | Posey | 493/439 |
| 4,747,817 | 5/1988 | Newsome | 493/438 |

OTHER PUBLICATIONS

Publication by MacGraphics, Inc. Entitled "Simfold 60", Publication Date Unknown, but Before Sep. 11, 1987.

*Primary Examiner*—William E. Terrell

*Attorney, Agent, or Firm*—Tarolli, Sundheim & Covell

[57] ABSTRACT

An improved folder apparatus includes a first folder assembly which forms a first fold in sheet material along the path of movement of the sheet material. A second folder assembly forms a second fold in the sheet material in a direction extending transversely to the path of movement of the sheet material. A third folder assembly forms a third fold in the sheet material with the first and third folds extending along the path of movement of the sheet material through the third folder assembly and the second fold at a leading edge portion of the sheet material. During the forming of the three folds, the sheet material is continuously moved through the folder assemblies without stopping. The third folder assembly includes an array of upper and lower tapes. The array of tapes tapers from a wide inlet portion of the third folder assembly toward a discharge portion of a third folder assembly. The array of upper and lower tapes maintains areas on opposite sides of the third fold flat in a horizontal plane white the sheet material is gripped by the tapes. A stacker assembly stacks the folded signatures received from the third folder assembly in a stack with major side surface areas in an upright orientation and with the third fold downward against a supporting surface.

11 Claims, 18 Drawing Sheets

FOLDER APPARATUS

This is a continuation of copending application Ser. No. 07/401,638 field on Aug. 31, 1989.

BACKGROUND OF THE INVENTION

The present invention relates to a new and improved apparatus forming folds in sheet material.

It has been suggested that a folder could be constructed in the manner disclosed in U.S. Pat. No. 2,039,335. This folder includes a chopper folder. A sheet is registered relative to a movable blade in the chopper folder by engagement with a stop. Therefore, movement of the sheet through the folder is interrupted. Of course, interrupting movement of the sheet through the folder is detrimental to high speed operation of the folder.

It has also been suggested that a folder could be constructed in the manner disclosed in U.S. Pat. No. 200,838. In this patent, sheet material from a printing press is engaged by a gripper connected with a tape. As the sheet material is moved by the gripper, a folding blade engages the sheet material and it is gripped by a folding roll. The folding roll cooperates with another roll to fold the sheet material. The sheet material is again folded by being moved between inner and outer shields by tapes.

Still another suggestion for the construction of a folder is disclosed in U.S. Pat. No. 4,747,817. In this patent, a shingled stream of signatures moves between upper and lower conveyor belts which accelerate each signature in turn. As the signatures are moved by the conveyor belts, they are folded downwardly on opposite sides of the conveyor belts by a cam means or former. The folded sheet material then enters a nip between a second pair of conveyor belts which crease or crimp the fold and change the orientation of the signatures from a vertical orientation to a horizontal orientation. The signatures are discharged from the second set of belts in a lapped stream which is re-oriented or turned through 90° from the original flow path of the sheet material.

SUMMARY OF THE PRESENT INVENTION

The present invention provides a new and improved folder apparatus which is operable at a relatively high speed to form a plurality of folds in sheet material. The folds are formed by a series of folder assemblies through which the sheet material continuously moves at a relatively high speed. The folded sheet material is stacked on edge by a stacker assembly.

The folder apparatus includes a first folder assembly which forms a fold extending along the path of movement of the sheet material. A second folder assembly forms a fold which extends transversely to the path of movement of the sheet material. Finally, a third folder assembly forms a fold which extends along the path of movement of the sheet material. During the folding of the sheet material by the folder assemblies, the sheet material is continuously moved through the folder assemblies without stopping.

When the sheet material leaves the last folder assembly, the opposite major side surfaces of the sheet material are in an upright orientation. A stacker assembly stacks the folded sheet material with the major side surfaces in the same orientation as when the sheet material leaves the last folder assembly, that is, with the major side surfaces upright.

BRIEF DESCRIPTION OF THE DRAWINGS

The foregoing and other features of the invention will become more apparent upon a consideration of the following description taken in connection with the accompanying drawings, wherein.

DESCRIPTION OF SPECIFIC PREFERRED EMBODIMENTS OF THE INVENTION

General Description

Figure 1:
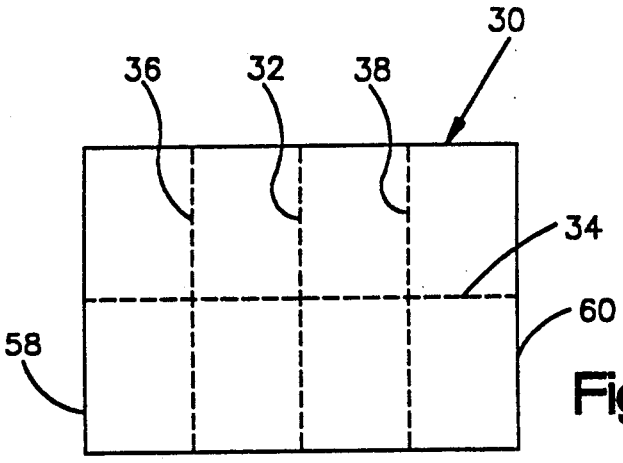
FIG. 1 is a a plan view of single sheet of material prior to folding.
Figure 2:
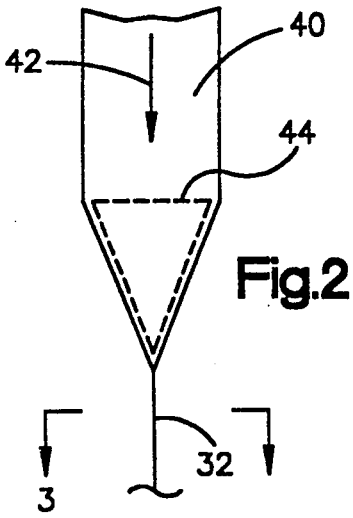
FIG. 2 is a schematic illustration of the manner in which a first fold is formed in a web of sheet material in a direction along the path of movement of the web through a first folder assembly.

Sheet material 30 (FIG. 1) is folded along a first fold line, indicated in dashed lines at 32 in FIG. 1, and then along a second fold line, indicated in dashed lines at 34 in FIG. 2. The second fold line 34 extends perpendicular to the first fold line 32. Finally, the sheet material 30 is folded along a third fold line, indicated in dashed lines at 36 and 38 in FIG. 1. The folded sheet material may be used as is or trimmed to form a pamphlet or portion of a book.

Figure 3:
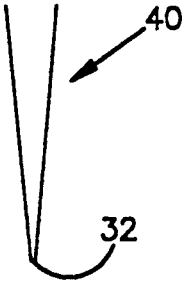
FIG. 3 is a schematic illustration, taken generally along the line 3—3 of FIG. 2, illustrating the manner in which the first fold is formed in the web.

To form the first fold 32, a web 40 (or multiple webs) is moved in the direction of the arrow 42 (FIG. 2) along a former board 44. As the web 40 moves past the nose of the former board 44, the fold 32 is formed in the web 40. The fold 32 (FIG. 3) extends along the path of movement of the web 40, that is in the direction of the arrow 42 in FIG. 2.

Figure 4:
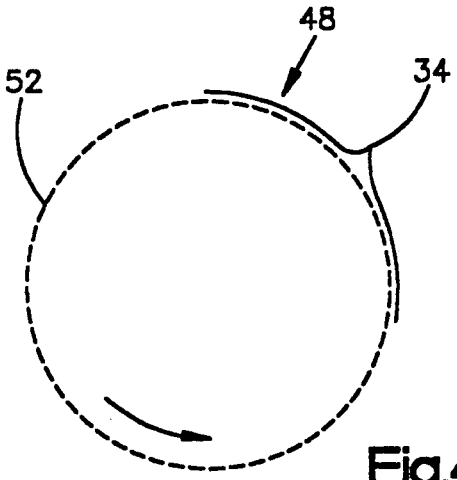
FIG. 4 is a schematic illustration depicting the manner in which a second folder assembly forms a fold extending transversely to the path of movement of the sheet material through the second folder assembly after the web has been cut to form a signature.
Figure 5:
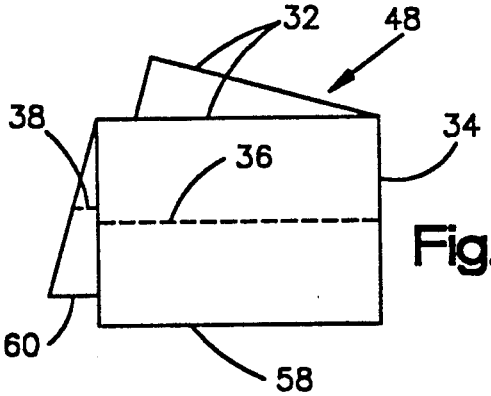
FIG. 5 is a schematic illustration depicting the manner in which sheet material is folded by the first and second folder assemblies.

After the fold 32 has been formed in the web 40, the web is cut to form a segment or signature 48 (FIG. 4). The signature 48 is formed from a piece of material having a size corresponding to the size of the sheet material 30 of FIG. 1. Of course, the fold 32 will have been formed in the signature 48. A tucking cylinder 52 cooperates with a jaw cylinder in a second folder assembly to form the second fold 34 which extends perpendicular to the path of movement of the signature 48 through the second folder assembly. This results in the second fold 34 extending perpendicular to the first fold 32 (see FIG. 5).

Figure 6:
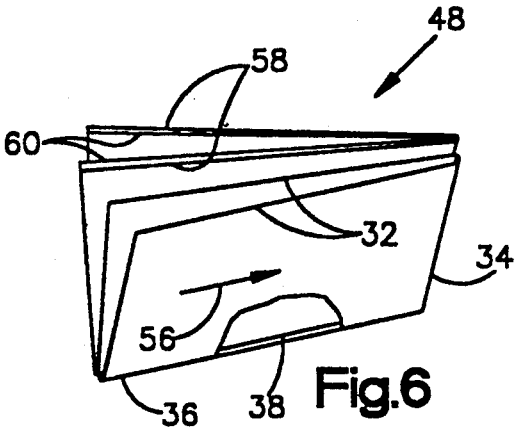
FIG. 6 is a partially broken away schematic illustration depicting the manner in which the sheet material is folded by a third folder assembly.
Figure 7:
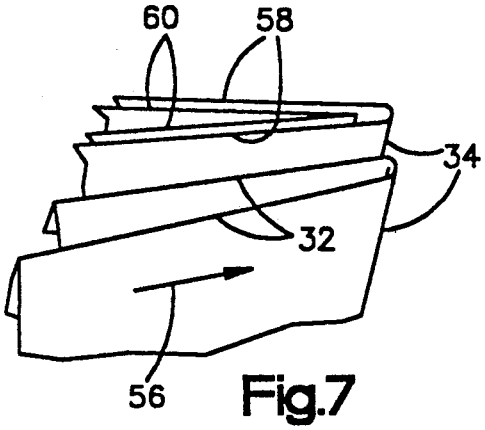
FIG. 7 is a fragmentary schematic illustration of the upper leading end portion of the folded sheet material of FIG. 6.

After the second fold 32 has been formed, the signature is again folded for a third time to simultaneously form the two folds 36 and 38. The fold 36 is outside the signature 48 in FIG. 6 while the fold 38 is disposed directly above and inside the fold 36. As the folds 36 and 38 are simultaneously formed, the signature 48 is moving through the third folder assembly in the direction of an arrow 56 (FIGS. 6 and 7). At this time, the second fold 34 is on a leading edge portion of the signature 48 and the fold 32 is on an upper edge portion of the signature. Edges 58 and 60 of the sheet material 30 (FIG. 1) are disposed adjacent to the fold 32 (FIG. 7). The opposite major side surfaces of the signature 48 are disposed in an upright orientation.

The folded signatures 48 are disposed in a stack 64 (FIGS. 8 and 9) in an on-edge orientation. Thus, major side surfaces of the signature 48 are disposed in an upright and side-by-side relationship. As the folds 32, 34, 36 and 38 are formed in the sheet material 30, the sheet material continuously moves through the folder assemblies without stopping until the sheet material is disposed in the stack 64. Thus, the sheet material goes from the continuously moving web to the stack 64 without stopping at any point in its path of travel. This enables the signatures 48 to be quickly formed and positioned in the stack 64.

Figure 10:
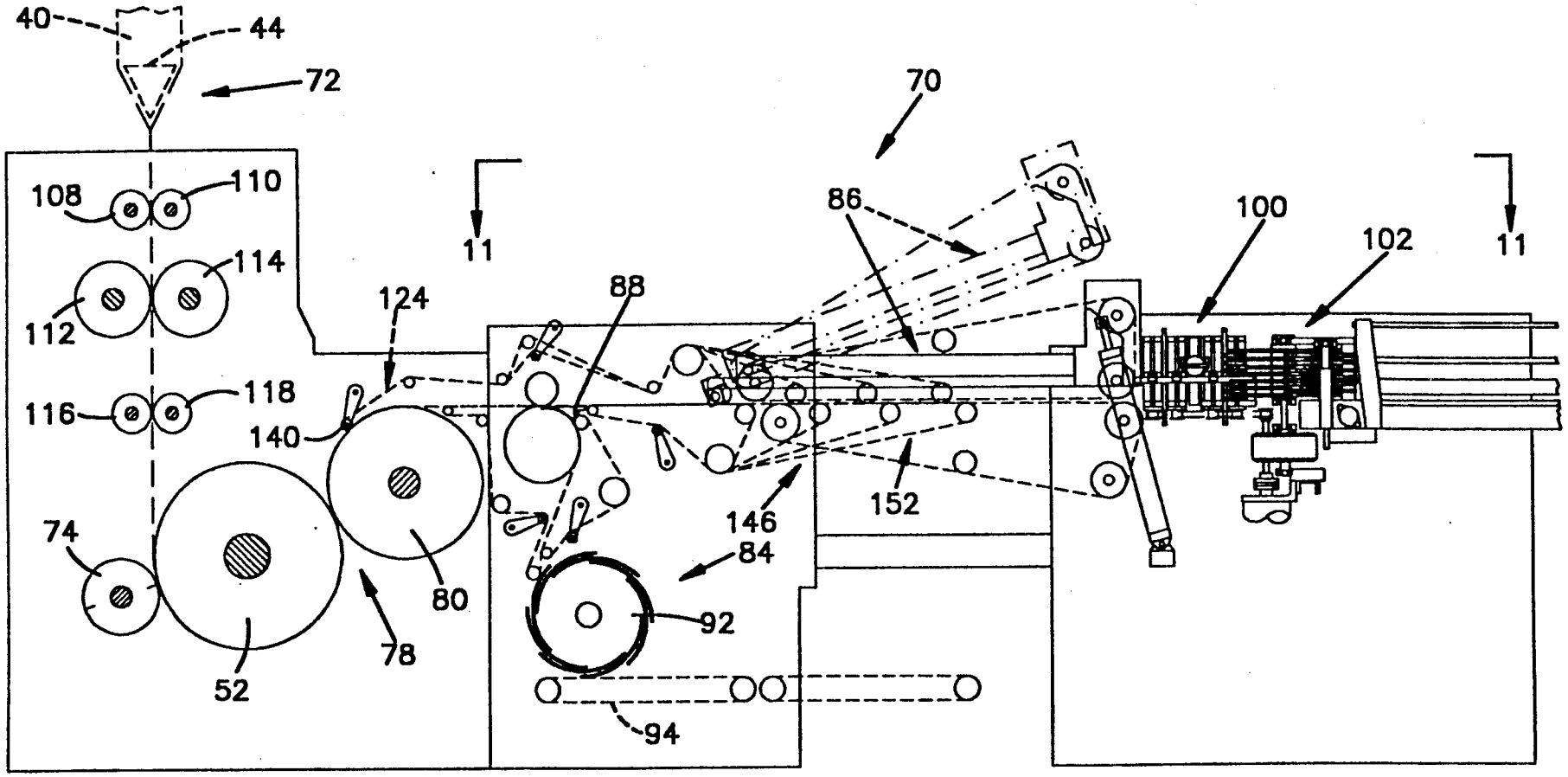
FIG. 10 is a schematicized side elevational view of a folder apparatus constructed in accordance with the present invention.

A folder apparatus 70 constructed in accordance with the present invention is illustrated in FIG. 10. The folder apparatus 70 includes a first folder assembly 72 in which the fold 32 is formed in the web 40. A cutting cylinder 74 cooperates with the tucking cylinder 52 to cut the folded web into a plurality of segments or signatures 48 (FIG. 4). In addition to the tucking cylinder 52, the second or jaw folder assembly 78 includes a gripper jaw or second folding cylinder 80 (FIG. 10). The second folding cylinder 80 cooperates with the tucking cylinder 52 to form the fold 34.

The signature 48 can move from the second folder 78 to either a shingled stream delivery conveyor 84 or a third folder assembly 86 depending upon the position of a divert gate 88. When the divert gate 88 is in one position, the signatures 48, in which only the folds 32 and 34 have been formed, are conducted to a delivery wheel 92. The delivery wheel 92 deposits the twice folded signatures 48 in a shingled stream on a belt conveyor 94.

Figure 11:
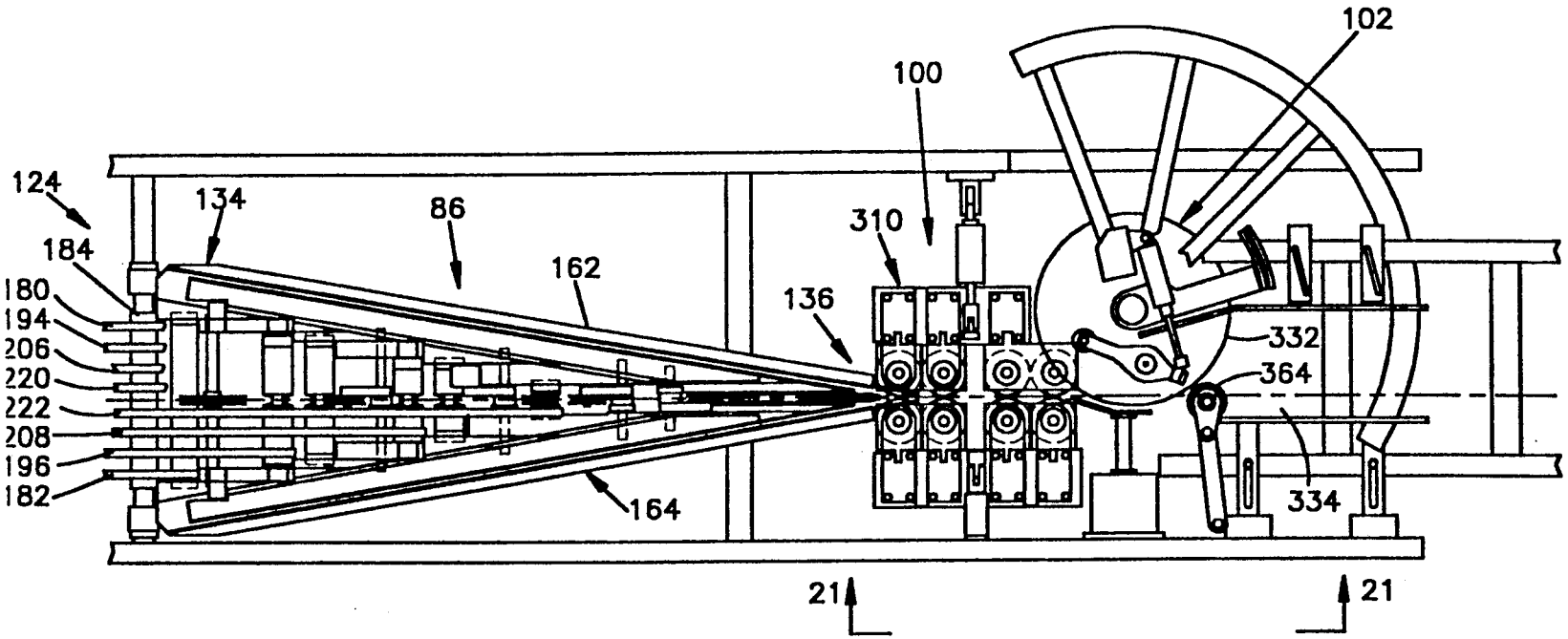
FIG. 11 is a plan view, taken generally along the line 11—11 of FIG. 10, illustrating the relationship between third or last folder assembly and a stacker assembly in the folder apparatus of FIG. 10.

When the signature 48 of FIGS. 6 and 7 is to be formed, the divert gate 88 (FIG. 10) is set to direct the signatures to the third folder assembly 86 (FIGS. 10 and 11). The third folder assembly 86 deflects the material of the signature 48 upwardly from a horizontal plane to simultaneously form the folds 36 and 38 (FIG. 6). The signature 48 moves from the third folder assembly 86 and to a discharge or creaser roll assembly 100 which presses the signature to further set the folds 32, 34, 36 and 38 in the signature. The folded signature 48 is discharged from the creaser roll assembly 100 to a stacker assembly 102 which stacks the signature in the on-edge orientation of FIGS. 8 and 9.

First and Second Folder Assemblies

Figure 12:
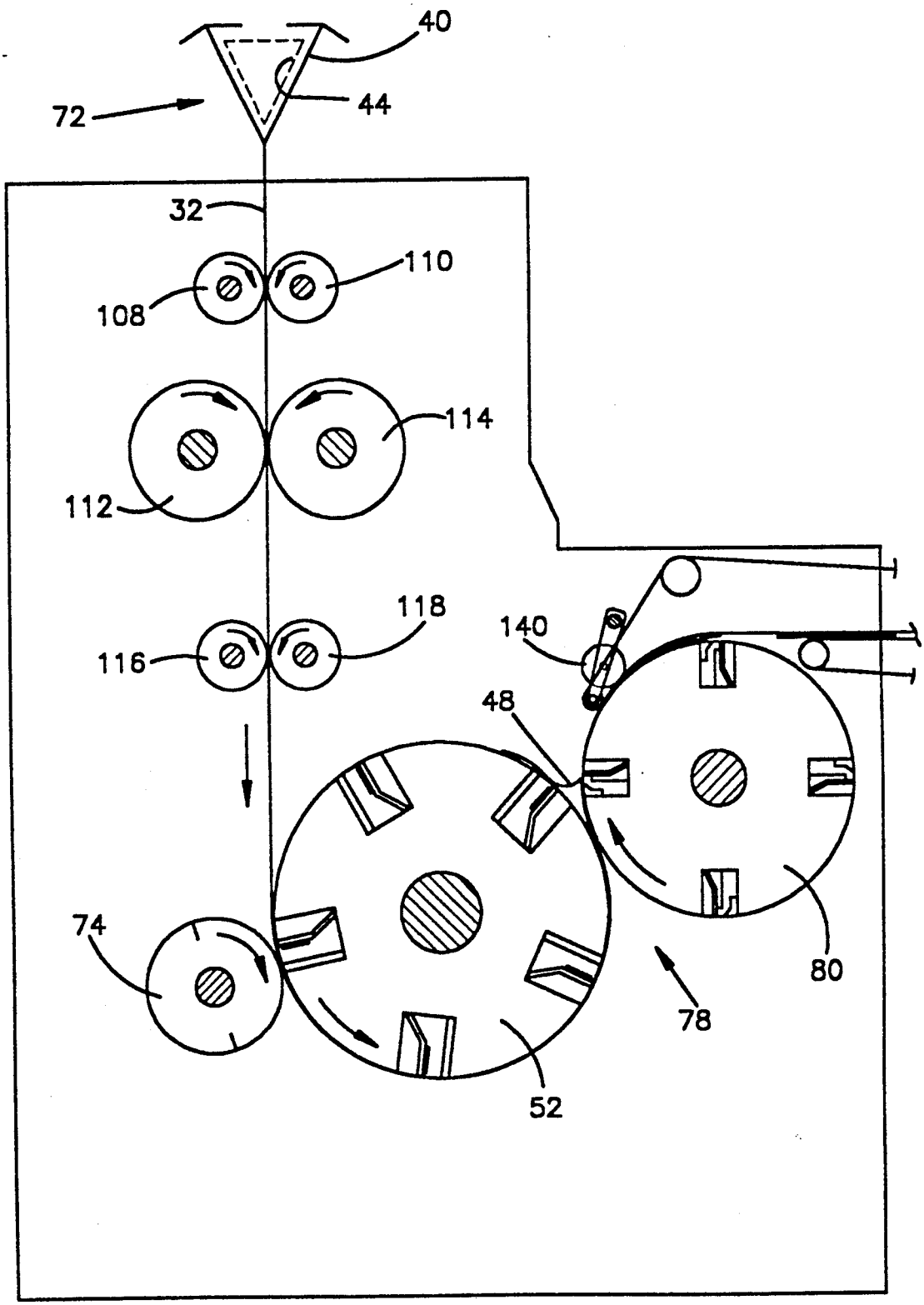
FIG. 12 is an enlarged schematic illustration of a portion of the folder apparatus of FIG. 10 and illustrating the relationship between a first folder assembly which forms a fold extending along the path of movement of the web of sheet material, a cutting cylinder, and a second folder assembly which forms a fold extending transversely to the path of movement of the sheet material.

The first folder assembly 72 (FIG. 12) folds the web 40 to form the fold 32. Thus, as the web 40 moves over a former board 44 having a known construction, the fold 32 is formed in the web 40 in a known manner. The folded web 40 enters the nip between a pair of pinch pullies or nip rollers 108 and 110 which set the fold 32. The folded web 40 then enters the nip between a pair of cross perforator rolls 112 and 114. The rolls 112 and 114 form perforations across the web in a direction perpendicular to the fold 32 at spaced apart intervals on the web. The perforations let air out of the web and weakens the web to facilitate the subsequent forming of the fold 34 at the perforations.

After leaving the nip between the perforator rolls 112 and 114, the web 40 enters the nip between a pair of creaser rollers 116 and 118. The web then moves to a nip formed between the cutting cylinder 74 and the tucking cylinder 52. The cutting cylinder 74 has a pair of cutting elements which cut the web 40 twice in each revolution of the cutting cylinder 74. The cutting cylinder 74 cooperates with the tucking cylinder 52 to cut the web into lengths to form the signatures 48 by cutting the web midway between transverse perforations formed by the perforator cylinders 112 and 114. At this time, a signature 48 formed by the cooperation between the cutting cylinder 74 and tucking cylinder 52 has only a single fold, that is the fold 32 formed in the first folder assembly 72.

The tucking cylinder 52 has impaling ends which engage the leading end portion of the web 40 before the web is cut by the cylinder 74. Cutting irons are disposed on the tucking cylinder 52. The cutting irons cooperate with blades on the cutting cylinder 74 to cut the web after the leading end portion of the web has been engaged by the impaling pins on the tucking cylinder.

The tucking cylinder 52 cooperates with a jaw cylinder 80 to make the second fold 34. A fold is formed crosswise of the signature 48, that is in a direction perpendicular to the path of travel of the signature around the tucking cylinder 52. The second fold 34 is formed when a tucking blade on the cylinder 52 presses the sheet material into an open jaw on the jaw cylinder 80. Although any desired number of sets of impaling pins, cutting irons and tucking blade units could be provided on the tucking cylinder 52, in one specific instance, the cylinder 52 was provided with five sets of impaling pins, five cutting irons and five sets of tucking blades. The jaw cylinder 80 is smaller than the tucking cylinder 52 and has only four sets of jaws. Of course, the jaw cylinder 80 could be provided with any desired number of jaws.

The tucking cylinder 52 and jaw cylinder 80 cooperate to sequentially form the folds 34 at the locations where the web was perforated by the cross perforator cylinders 112 and 114. The manner in which the folds 34 are formed across the signature 48 by the cooperation between the tucking cylinder 52 and jaw cylinder 80 is well known and will not be further described herein to avoid prolixity of description.

The signatures 48 are continuously gripped. Thus, a signature 48 with the folds 32 and 34 formed therein, is gripped between the jaw cylinder 80 and a plurality of upper tapes while the signature is still under the control of the jaw cylinder 80. The leading end portion of the signature 48 is then gripped between lower delivery tapes 126 and the plurality of upper tapes 124 while the trailing portion of the signature is still gripped between the tapes 124 and the jaw cylinder 80.

When the divert gate 88 is raised, the signatures 48 are conducted by the tapes 124 and 126 to a nip formed between the delivery tapes 128 and a tape drum 130. The delivery tapes 126 and 128 grip the signatures 48 and move them downwardly (as viewed in FIG. 13) to the fan wheel 92. The delivery fan wheel 92 rotates in a counterclockwise direction (as viewed in FIG. 13) and deposits the signatures in a lapped stream on the belt conveyor 94. Although the option of having the signatures delivered in a lapped stream onto the belt conveyor 94 with only the two folds 32 and 34 formed in the signatures is provided, this manner of operating the folder apparatus 70 is not, itself, a feature of the invention.

Third Folder Assembly

The third folder assembly 86 (FIG. 11) is operable to form the folds 36 and 38 in the signatures 48 as the signatures move from a wide inlet end portion 134 of the folder assembly 86 to an outlet or discharge end portion 136 of the third folder assembly 86. To assist the folder assembly 86 in accurately forming the folds 36 and 38 extending in the direction of travel of the signatures 48 through the folder assembly, a creaser roll 140 (FIG. 12) cooperates with the jaw cylinder 80 to form creases in the signatures at the locations where the folds 36 and 38 are to be located. A second creaser roll 142 cooperates with the tape drum 130 (FIG. 13) to again crease the signatures 48 at the locations where the folds 36 and 38 are to be formed. Of course, one or both of the creaser rolls 140 or 142 could be omitted if desired.

The third folder assembly 86 includes an array 146 (FIGS. 14 and 15) of tapes. The array 146 of tapes extends from the jaw cylinder 80 (FIG. 13) through the relatively wide inlet portion 134 of the folder assembly 86 toward the relatively narrow outlet portion 136 (FIG. 15). The array 146 of tapes tapers from the wide inlet portion 134 toward the narrow outlet portion 136 of the folder assembly 86. It should be understood that some of the tapes in the upper and lower portions (as viewed in FIG. 14) of the array 146 of tapes have been broken away in FIG. 15 to more fully expose the components of the folder assembly 86. However, in the third folder assembly 86, the tapes in the upper portion (as viewed in FIG. 14) of the array 146 of tapes are generally a mirror image of the tapes in the lower portion of the array.

Figure 13:
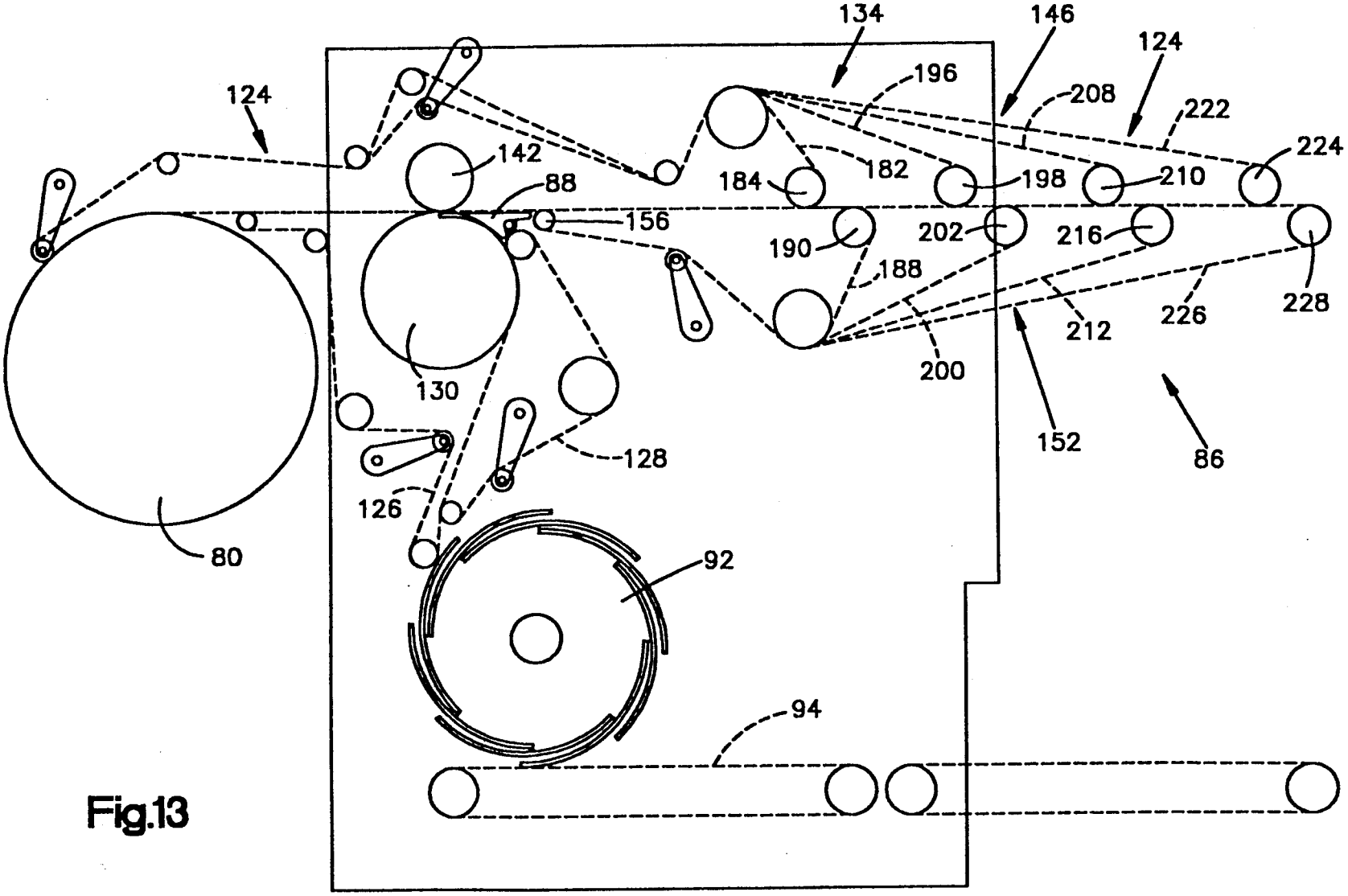
FIG. 13 is an enlarged schematic illustration of a portion of FIG. 10 and illustrating apparatus for moving sheet material to and part way through the third folder assembly.
Figure 14:
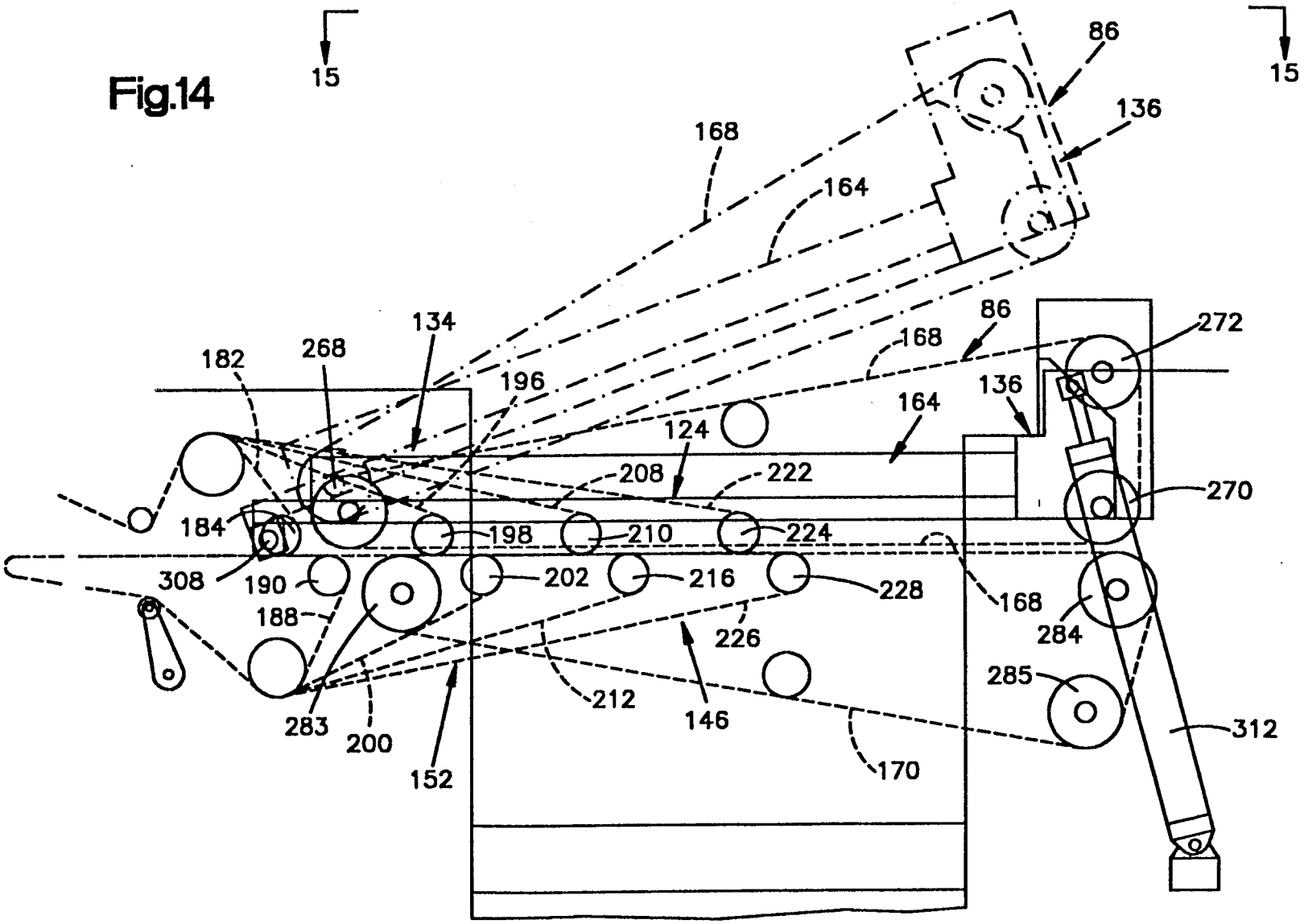
FIG. 14 is a schematic elevational view of the third folder assembly, the folder assembly being shown in solid lines in a normal operating position and in dashed lines in a raised position to facilitate clearing of a jam or for maintenance.
Figure 15:
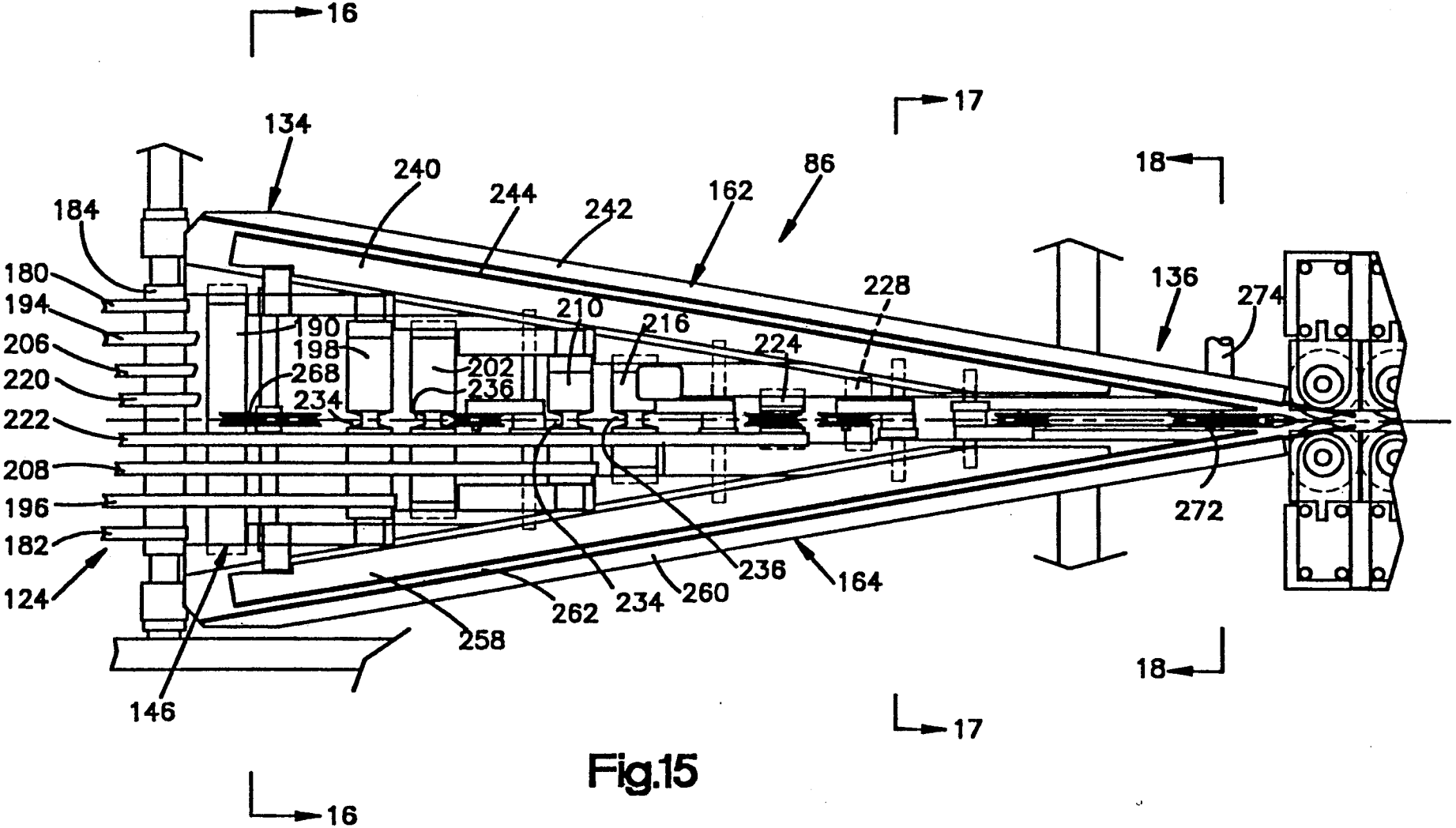
FIG. 15 is a plan view, taken generally along the line 15—15 of FIG. 14, further illustrating the construction of the third folder assembly.

The array 146 of tapes includes the plurality of upper tapes 124 and a plurality of lower tapes 152 (FIGS. 13 and 14). The upper tapes 124 engage the signatures 48 on the jaw cylinder 80 (FIG. 13). The upper tapes 124 cooperate with the delivery tapes 126 to securely grip the signatures 48 before they leave the jaw cylinder 80. As the signatures 48 move past the divert gate 88 and while they are still gripped between the tapes 124 and 126, the signatures are gripped by the tapes 124 and 152.

The tapes 124 and 152 firmly grip the signatures 48 during movement of the signatures to the inlet portion 134 of the folder assembly 86. The tapes 124 and 152 also grip the signatures as they move toward the outlet portion 136 of the folder assembly 86.

The upper tapes 124 extend from the jaw cylinder 80 (FIG. 10) to the central portion of the second folder assembly 86 to maintain continuous engagement of the upper tapes with the signatures 48. In order to enable the signatures to be directed downwardly to the delivery conveyor wheel 92 and belt conveyor 94 at the divert gate 88, the lower tapes 152 extend from a tape roll 156 (FIG. 13) into the third folder assembly 86 (FIG. 14). However, the conveyor tapes 126 (FIG. 13) cooperate with the upper tapes 124 to securely grip the leading end portion of each of the signatures 48 in turn while the trailing end portions of the signatures are firmly held against the jaw cylinder 80 by the upper tapes 124. Thus, the upper tapes 124 cooperate with the jaw cylinder 80, conveyor tapes 126 and the lower tapes 152 to maintain a continuous firm grip on each of the signatures from a location in the second folder assembly 78 to the central portion of the third folder assembly 86. This is done in order to be certain that the signatures 48 are moved in a controlled manner between the second folder assembly 78 and third folder assembly 86.

In the third folder assembly 86, the upper tapes 124 (FIG. 14) cooperate with the lower tapes 152 to form a flat base. The tapes 124 and 152 hold the portion of the signatures 48 between the upper and lower tapes 124 and 152 flat in a horizontal plane. Since the array 146 of upper and lower tapes 124 and 152 tapers longitudinally of the third folder assembly 86 (FIG. 15), the distance for which the flat horizontal areas of the signatures extend outwardly from a longitudinal center line of the conveyor assembly 86 decreases as the signatures move along the array 146 of tapes. Even though the extent of the area of engagement of the tapered array 146 of upper and lower tapes with the opposite major side surfaces of the signatures 48 decreases along the path of movement of the signatures through the third folder assembly 86, the portion of the signatures engaged by the tapered array 146 of tapes is firmly gripped and maintained flat in a horizontal plane by the cooperation between the upper and lower tapes 124 and 152.

A pair of formers 162 and 164 (FIG. 15) are disposed on opposite sides of the longitudinally extending center line of the folder assembly 86. The formers 162 and 164 deflect portions of the signatures 48 upwardly on opposite sides of the folds 36 and 38. The formers 162 and 164 extend from the relatively wide entrance end portion 134 of the third folder assembly 86 to the narrow outlet end portion 136 of the folder assembly.

As a signature 48 is moved from left to right (as viewed in FIG. 15) through the folder assembly 86 and the size of the base formed by the array 146 of belts decreases, the formers 162 and 164 engage an increasingly large area of the signature. As the area of the signature 48 engaged by the formers 162 and 164 increases, the formers smoothly cam or deflect the signature upwardly on opposite sides of the fold lines 36 and 38.

When a signature 48 is moved into the relatively wide entrance portion 134 (FIG. 15) of the third folder assembly 86 by the upper and lower tapes 124 and 152 (FIG. 14), the signature is flat in a horizontal plane. The fold 34 forms the leading edge portion of the signature. The fold 32 extends parallel to the longitudinal axis of the third folder assembly 86 and the direction of movement of the signature through the third folder assembly.

As the upper and lower tapes 124 and 152 move a signature rightwardly (as viewed in FIG. 15) from the entrance 134 to the third folder assembly 86, opposite outer edge portions of the signature engage the formers 162 and 164 and deflect or bend the outer edge portions of the signature upwardly without permanently deforming the signature. As the signature 48 continues to move into the third folder assembly 86, the transverse extent of the tapered array 146 of upper and lower tapes 124 and 152 decreases and the extent of engagement of the signatures with the formers 162 and 164 increases as opposite sides of the signature are moved toward each other about the folds 36 and 38. As the signature 48 enters and moves through the outlet end portion 136 of the third folder, the folds 36 and 38 are completed.

At or shortly after the inlet or entrance portion 134 of the third folder assembly 86, upper and lower creaser belts 168 and 170 (FIGS. 14 and 16) engage opposite sides of the signature at the location where the folds 36 and 38 are to be formed. The creaser belts 168 and 170 extend along the longitudinal central axis of the folder assembly 86. The creaser belts 168 and 170 extend from the inlet end portion 134 of the folder assembly 86 to the outlet end portion 136 of the folder assembly 86. The upper and lower creaser belts 168 and 170 maintain a firm grip on opposite sides of each of the signatures 48 at the folds 36 and 38 before and after the signature has moved past the end of the tapered array 146 of upper and lower tapes 124 and 152. This results in the signatures moving in a controlled manner through the folder assembly 86, first under the influence of the tapes 124 and 152 and then under the influence of the creaser belts 168 and 170.

In addition to promoting movement of the signatures 48 through the folder assembly 86 in a controlled manner, the upper and lower creaser belts 168 and 170 crease the signatures to make certain that the third folds 36 and 38 are formed at the desired location on the signature. Thus, the upper creaser belt 168 has a tapered nose 174 (FIG. 16) which cooperates with a longitudinally extending groove 176 in the lower creaser belt 170. The nose 174 of the upper creaser belt cooperates with the groove 176 in the lower creaser belt 170 to maintain a crease in the signature at the location where the folds 36 and 38 are to be formed and to securely hold the signature 48 against sidewise movement relative to the longitudinal central axis of the folder assembly 86.

Figure 16:
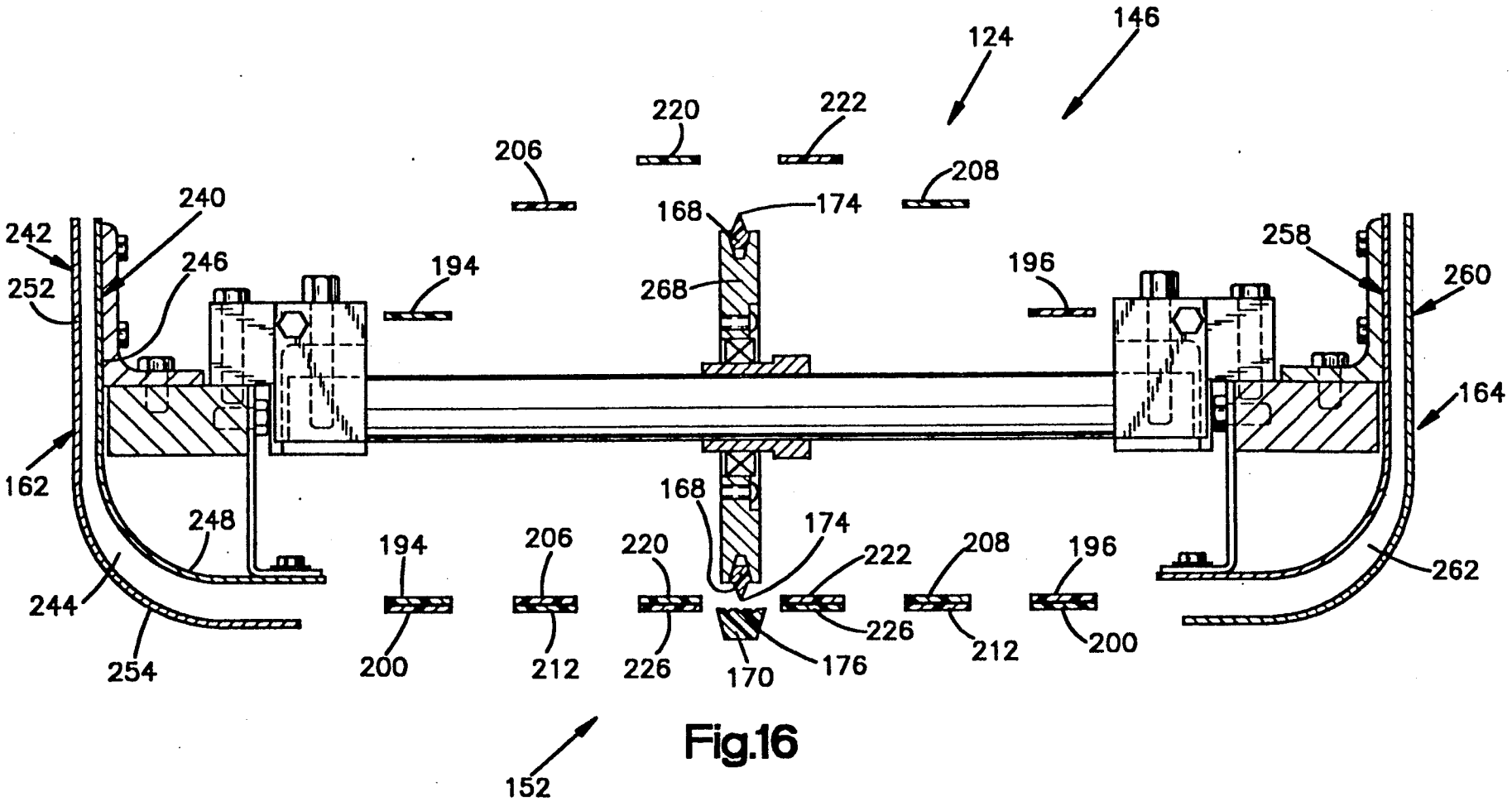
FIG. 16 is a fragmentary sectional view, taken generally along the line 16—16 of FIG. 15, illustrating the relationship between upper and lower creaser belts, a plurality of delivery tapes, and inner and outer former walls at a relatively wide entrance portion of the third conveyor assembly.

The upper tapes 124 have lower runs with flat horizontal side surfaces which engage the upper major side surface of a signature in the third folder assembly 86. Similarly, the lower tapes 152 have upper runs with flat horizontal side surfaces which engage the lower side of a signature in the third folder assembly 86 at a location opposite from an upper tape (FIG. 16). The signature is firmly gripped between the horizontal lower runs of the upper tapes 124 and the horizontal upper runs of the lower tapes 152.

The upper tapes 124 include a pair of tapes 180 and 182 which extend around an upper roller 184 (FIG. 15). Similarly, a pair of lower tapes, indicated at 188 in FIG. 13, extend around a lower roller 190 and are disposed opposite from and are aligned with the upper tapes 180 and 182.

A second pair of upper tapes 194 and 196 (FIGS. 13 and 15) extend around an upper roller 198. Although the tapes 194 and 196 extend past the roller 184 to the roller 198 (FIG. 15), an upper side surface of the lower run of the tapes 194 and 196 engage and are positioned by a cylindrical outer side surface of the roller 184. A pair of lower tapes 200 (FIG. 13) cooperate with the upper tapes 194 and 196 and extend around a lower roller 202 (FIGS. 13 and 15).

A third pair of upper tapes 206 and 208 extend around a roller 210 and have horizontal lower runs which cooperate with a pair of lower tapes 212 which extend around a lower roller 216. Finally, a central pair 220 and 222 (FIGS. 13 and 15) of upper tapes extend around a roller 224 and cooperate with a pair of lower tapes indicated at 226 in FIG. 13. The lower tapes 226 extend around a lower roller 228 (FIG. 13). The horizontal lower runs of the tapes 220 and 222 are positioned relative to the horizontal upper runs of the lower tapes 226 by cylindrical side surfaces of each of the rollers 210, 198, and 184. Similarly, horizontal upper runs of the lower pair of tapes 226 are positioned relative to the upper tapes 220 and 222 by the rollers 216, 202 and 190.

The upper creaser belt 168 (FIGS. 14 and 16) extends past the upper rollers 198, 210, and 224. Therefore, these rollers are provided with annular central grooves 234 to accommodate the upper creaser belt 168 in the manner illustrated in FIG. 17 for the roller 224. Similarly, the lower creaser belt 170 extends past the rollers 202, 216 and 228 (FIG. 13). Therefore, each of these rollers is also provided with an annular central groove 236 to accommodate the lower creaser belt 170 in the manner shown in FIG. 17.

The two formers 162 and 164 (FIG. 15) engage areas of the signature on opposite sides of the longitudinal center line of the folder assembly 86. The extent of engagement of the formers 162 and 164 with the sheet material of the signatures increases as the extent of engagement of the tapered array 146 of tapes decreases. The former 162 includes an inner former wall 240 and an outer former wall 242. A longitudinally extending space 244 (FIG. 16) is provided between the inner and outer former walls 240 and 242. During operation of the folder assembly 86, portions of the signatures 48 move through the space 244.

The inner former wall 240 has an upright or vertical side section 246 (FIG. 16) and an arcuately curving lower section 248. Similarly, the outer former wall 242 has an upright side section 252 and an arcuately curving lower section 254. The upright side section 252 of the outer former wall 242 extends parallel to the side section 246 of the inner former wall 240. The arcuate lower sections 248 and 254 of the former walls 240 and 242 have different radii of curvature. Therefore, the signature receiving space 244 tapers from a relatively wide entrance between the lower side sections 248 and 254 to the relatively narrow space between the upright side sections 246 and 252.

The former 164 has a configuration which is a mirror image of the configuration of the former 162. Thus, the former 164 includes an inner side wall 258 and an outer side wall 260. A space 262 is provided between the inner and outer side walls 258 and 260 to receive a portion of a signature.

As the two formers 162 and 164 converge toward each other along the longitudinal axis of the folder assembly 86, the extent of a signature received in the spaces 244 and 262 between the former side walls increases. As the former walls converge, the arcuate lower sections of the former walls approach each other. However, before the lower sections meet, the arcuate lower sections of the walls are merged or blended into the vertical upright sections of the walls.

The merging of the arcuate lower sections of the former walls 240, 242, 258 and 260 into the vertical upright side sections results in the arcuate lower sections of the wall having transitional conical shapes which extend between the circular configurations of FIG. 16 and an entirely straight, vertical, configuration at the outlet 136 from the former. Thus, at a location adjacent to the inlet end portion 134 of the folder 86 (FIG. 16), the arcuate lower section 248 of the inner side wall 240 has a configuration which corresponds to a quarter of a circle. A blending area which forms a quarter of a cone extends from a location immediately ahead of the outlet portion 136 (FIG. 17) into the outlet portion of the folder assembly (FIG. 18). As the merging of the lower section 248 of the former wall 240 into the upper section 246 occurs, the lower section 248 of the inner side wall approaches a vertical or upright orientation (FIG. 18).

Figure 17:
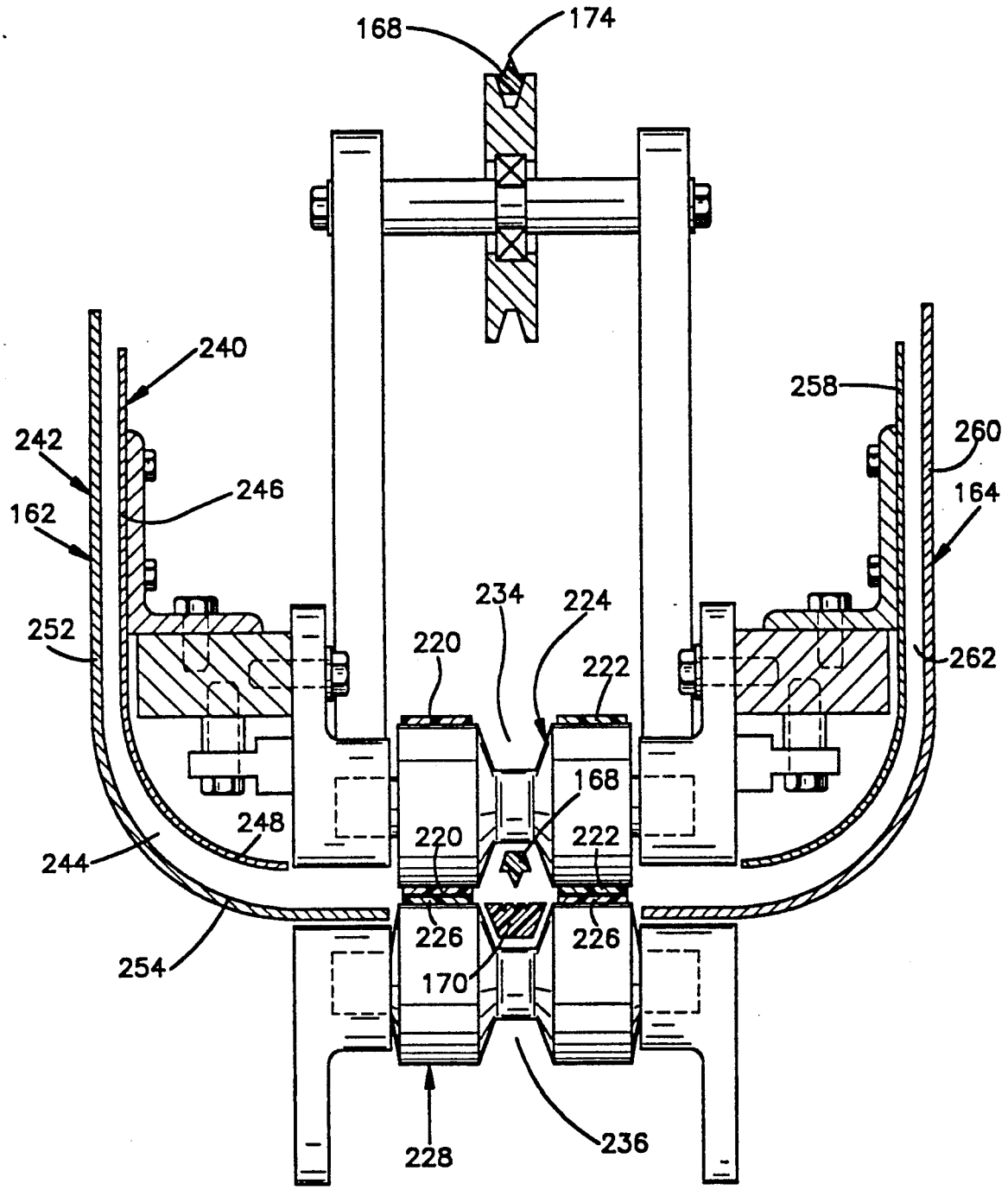
FIG. 17 is a fragmentary sectional view, taken generally along the line 17—17 of FIG. 15, illustrating the relationship between upper and lower creaser belts, delivery tapes, and inner and outer former walls at a location ahead of a discharge portion of the third folder assembly.
Figure 18:
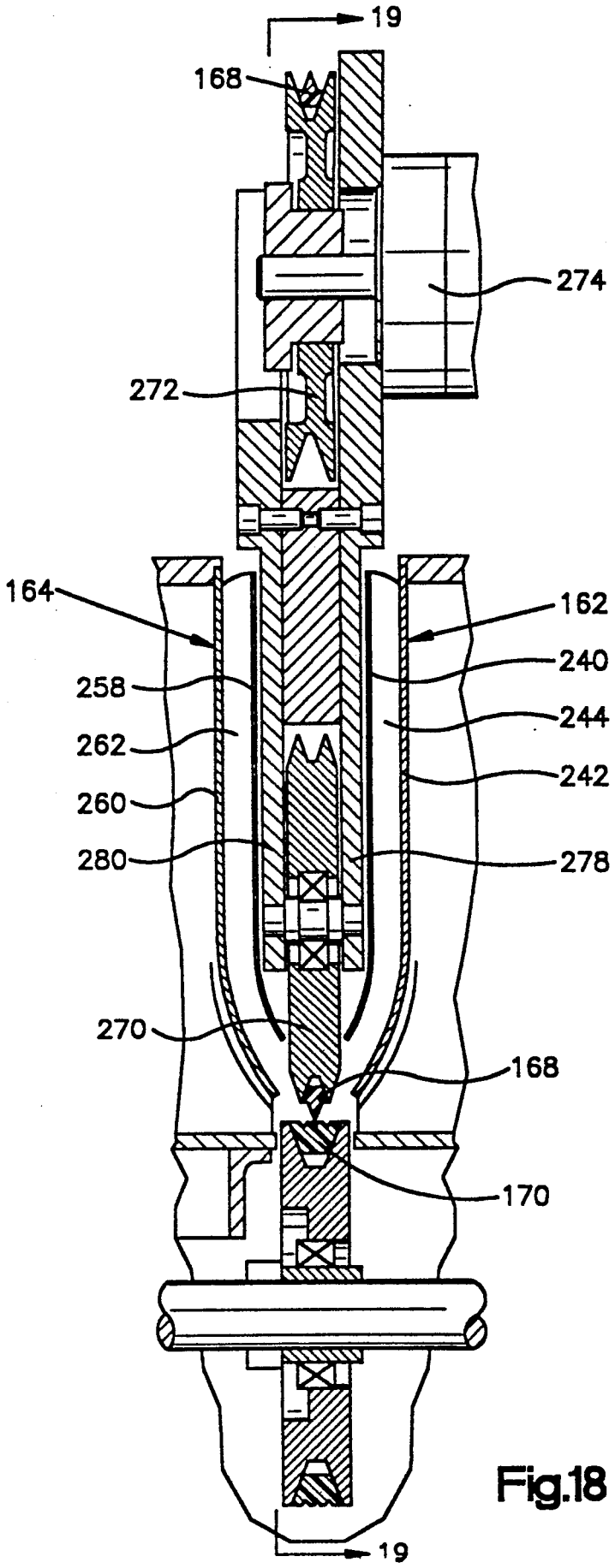
FIG. 18 is a fragmentary sectional view, taken generally along the line 18—18 of FIG. 15, illustrating the relationship between the creaser belts and inner and outer former walls at the discharge portion of the third folder assembly.

The configuration of the outer side wall 242 of the former 162 changes in the same manner as the configuration of the inner side wall 240 (FIGS. 16, 17 and 18). Therefore, at the outlet from the former 162, the inner side wall 240 is vertical and extends parallel to the outer side wall 242. The gentle blending or merging of the lower sections 248 and 254 of the inner and outer side walls 240 and 242 to a vertical orientation results in a portion of the signature disposed in the former 162 being gently rolled to a vertical orientation. Once this has been achieved, the inner side wall 240 is terminated.

The lower sections of the side walls 258 and 260 of the former 164 blend or merge with the upper sections in the same manner as do the lower sections of the side walls 240 and 242 of the former 162. Therefore, the portion of the signature disposed in the former 164 is also gently rolled to a vertical orientation. Once this has been achieved at the outlet portion 136, the inner side wall 258 is terminated.

The continuous upper creaser belt 168 extends from a rear pulley or sheave 268 (FIGS. 14, 15 and 16), forwardly to a lower front sheave or pulley 270 (FIGS. 14 and 18). The upper creaser belt 168 then extends around an upper sheave 272 back to the rear sheave 268. It should be noted that although the sheaves 268 and 272 have been shown in FIG. 15, the upper creaser belt 168 has been omitted in FIG. 15 in order to more fully illustrate the components of the folder assembly 86.

The upper sheave 272 is driven by a motor 274 (FIGS. 15 and 18) to drive the upper creaser belt 168. The inner former side walls 240 and 258 (FIG. 18) are disposed adjacent or abut supports 278 and 280 for the lower front creaser belt pulley 270. This results in the portions of the signature 48 disposed on opposite sides of the fold 36 moving as closely as possible together at the portions of the formers 162 and 164 disposed adjacent to the forward creaser belt pulley 270.

The continuous lower creaser belt 170 is supported and driven in the same manner as the upper creaser belt 168. Thus, the lower creaser belt 170 extends from a rear pulley or sheave 283 (FIG. 14), forwardly to an upper front sheave 284. The lower creaser belt 170 then extends around a lower sheave 285 back to the rear sheave 283. The lower sheave 283 is driven by a motor (not shown) in the same manner that the sheave 272 is driven by the motor 274.

Figure 19:
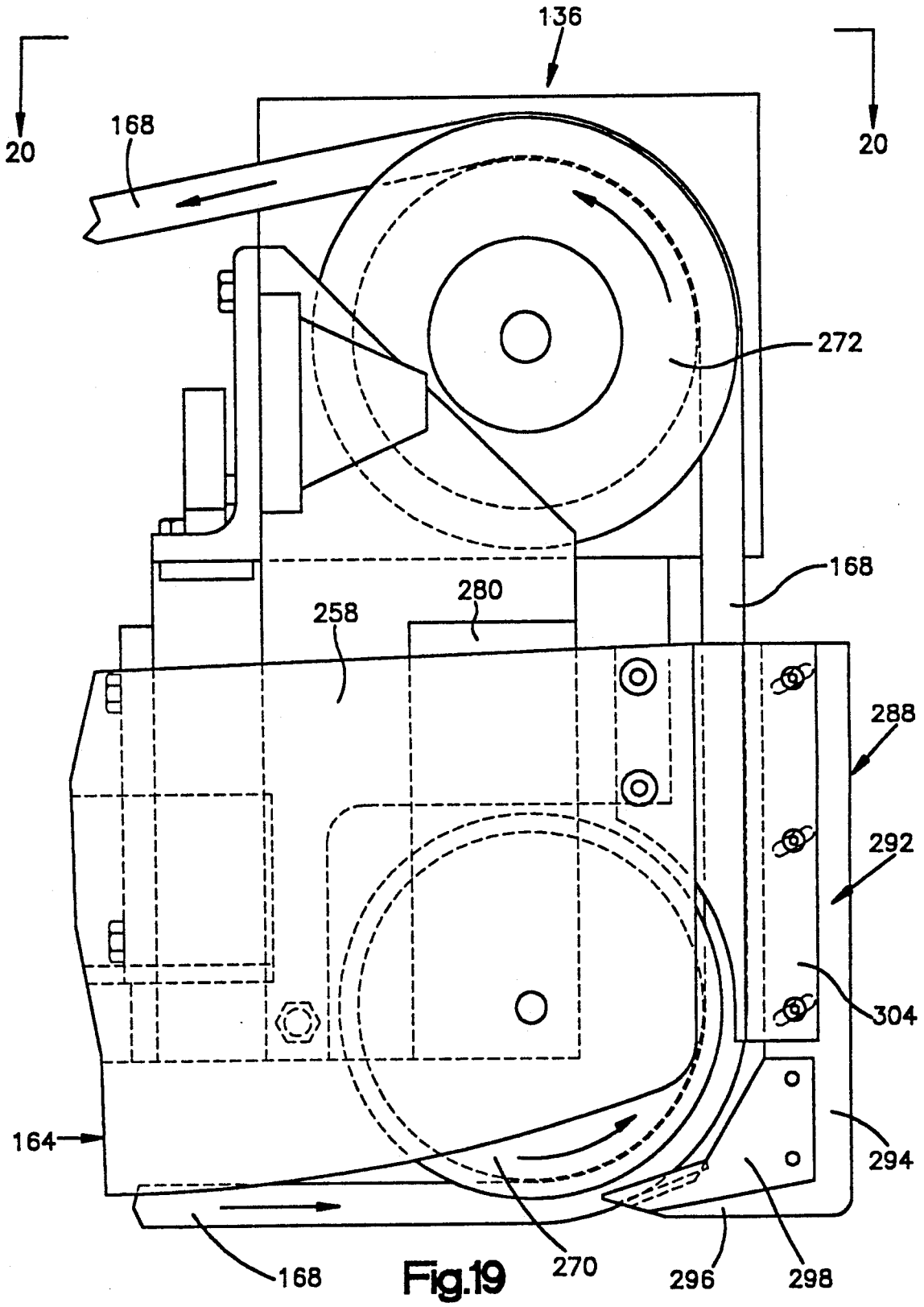
FIG. 19 is an enlarged view further illustrating the the discharge portion of the third folder assembly.
Figure 20:
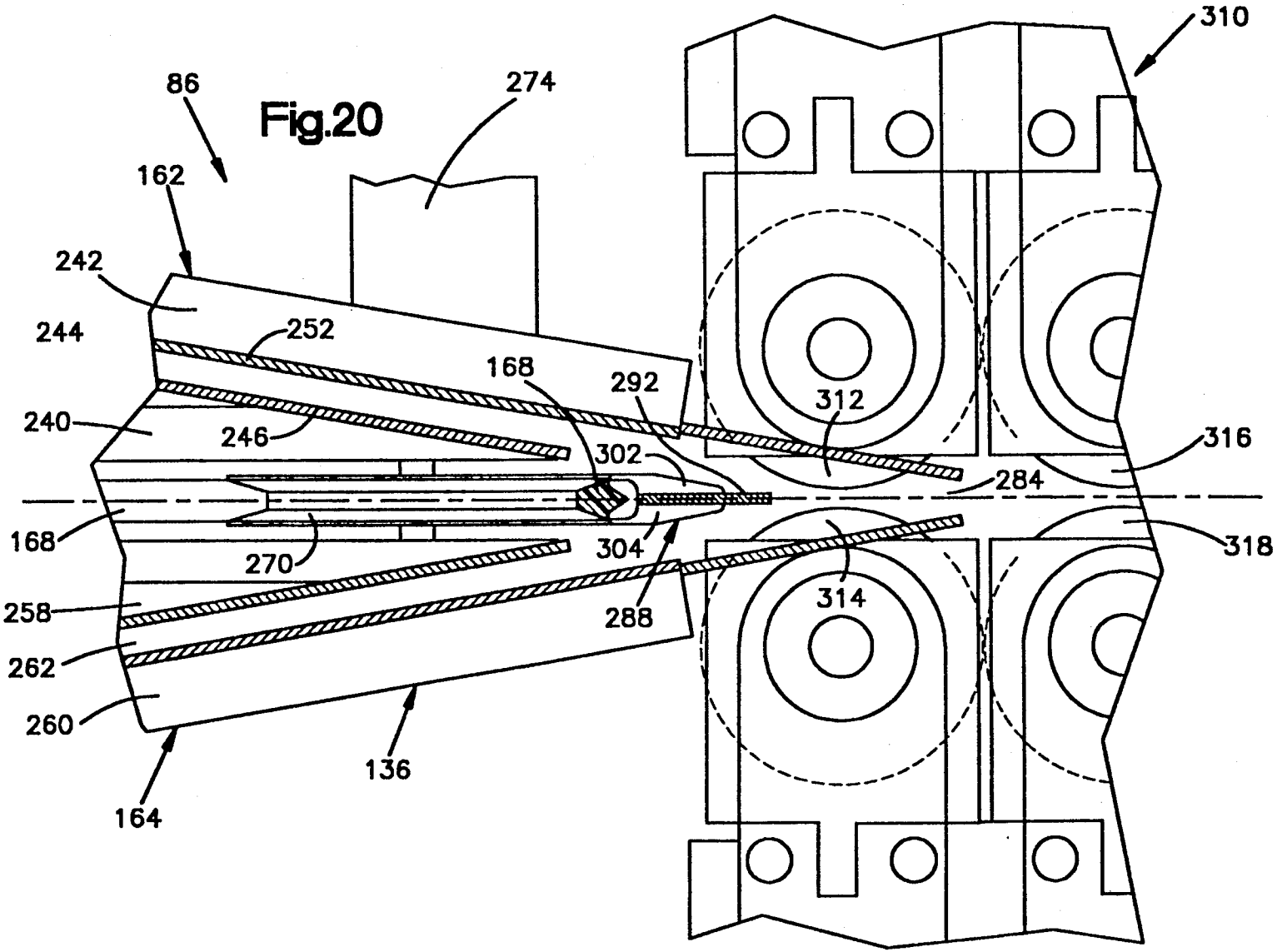
FIG. 20 is a plan view, taken generally along the line 20—20 of FIG. 19, illustrating the relationship between the discharge portion of the third folder assembly and a discharge or creaser roll assembly.

As is perhaps best seen in FIG. 19, the inner wall 258 of the former 164 ends just slightly rearwardly of the forwardmost portion of the pulley 270 and creaser belt 168. The inner wall 240 of the opposite former 162 also ends adjacent to the forward portions of the creaser belt pulleys 270 and 272 (FIG. 20). Although the inner former walls 240 and 258 end on opposite sides of the creaser belt pulleys 270 and 272, the outer former walls 242 and 260 extend forwardly past the pulleys 270 and 272 (FIG. 20) to form an outlet opening 284 through which the folded signatures 48 are discharged from the third folder assembly 86.

A blade or guard assembly 288 (FIG. 19) is provided immediately forwardly of the lower creaser belt pulley 270. The blade assembly 288 includes a center plate 292 which is disposed on the longitudinal center line of the folder 86 (FIG. 20). The center plate 292 has a relatively long vertically extending portion 294 (FIG. 19) and a relatively short horizontally rearwardly extending portion 296.

A lower pair of guards 298, only one of which is shown in FIG. 19, are disposed on opposite sides of the center plate 292 and extend into an overlapping relationship with opposite sides of the creaser belt 168. The guards 298 cooperate with the creaser belt to engage the interior of each signature in turn and separate the signature from the creaser belt. A second pair of guards or mounting plates 302 and 304 (FIGS. 19 and 20) extend between the center plate 292 and the inner former walls 240 and 258 to block the space between the outer ends of the inner former walls 240 and 258 and the vertically extending run of the creaser belt 168 (FIG. 19). It is contemplated that the blade assembly 288 may engage inner side surfaces of the signatures and promote the formation of the folds 36 and 38. In addition, the blade assembly 288 separates the signatures from the creaser 168.

If a jam should occur at the outlet portion 136 of the folder assembly 86, the folder assembly can be pivoted upwardly about a pivot connection 308 (FIG. 14) to move the folder assembly from the normal operating or running position shown in solid lines in FIG. 14 to the raised position shown in dashed lines. When the folder assembly 86 has been moved to the raised position, the outlet or discharge portion 136 of the folder assembly is accessible to enable a jam to be readily cleared. A piston and cylinder type motor 312 is provided to move the folder assembly between the lowered position shown in solid lines in FIG. 14 and the raised position shown in dashed lines in FIG. 14.

Creaser Roll and Stacker Assemblies

Figure 21:
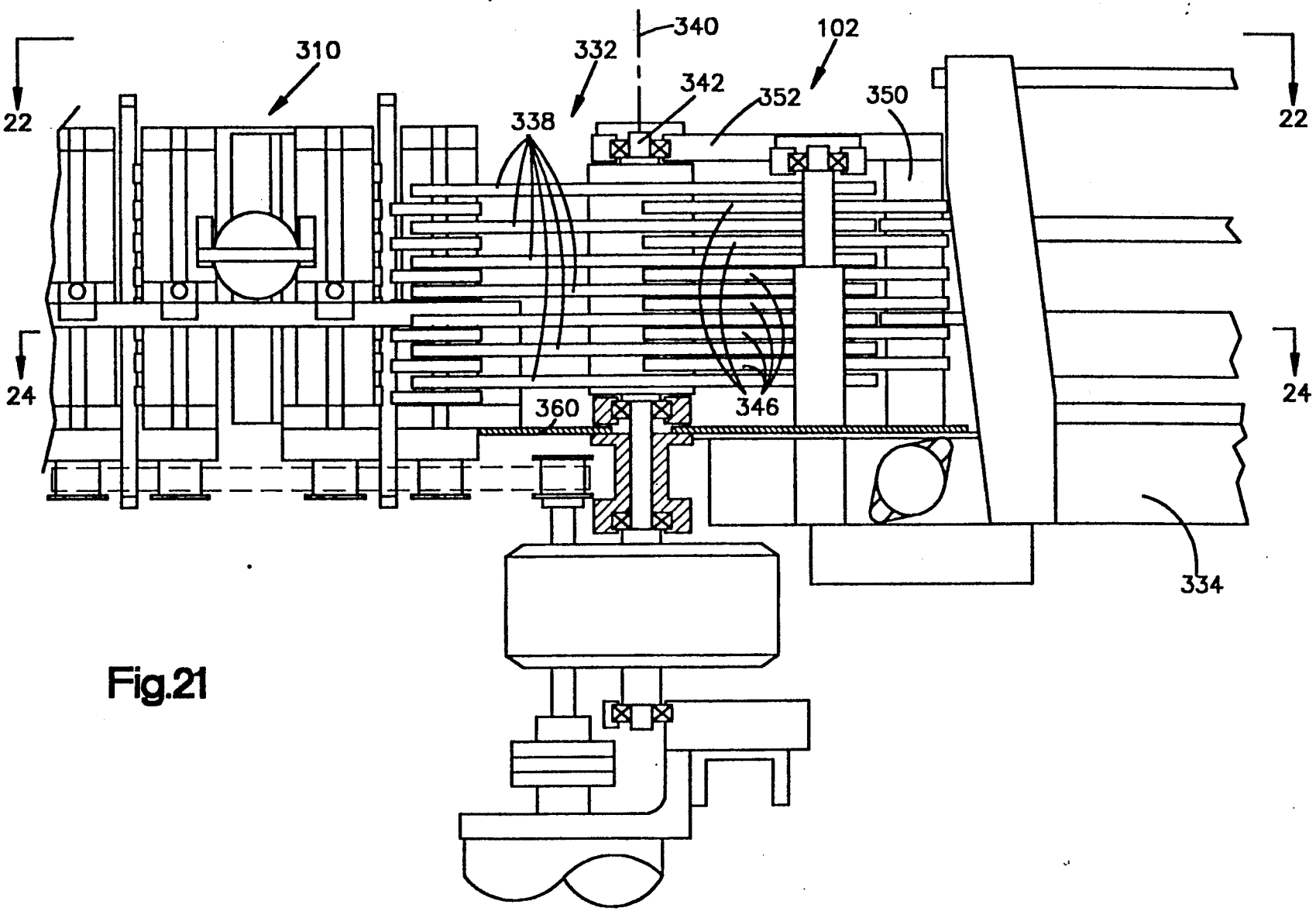
FIG. 21 is a side elevational view, taken generally along the line 21—21 of FIG. 11, illustrating the relationship between the creaser roll assembly and a stacker assembly.
Figure 22:
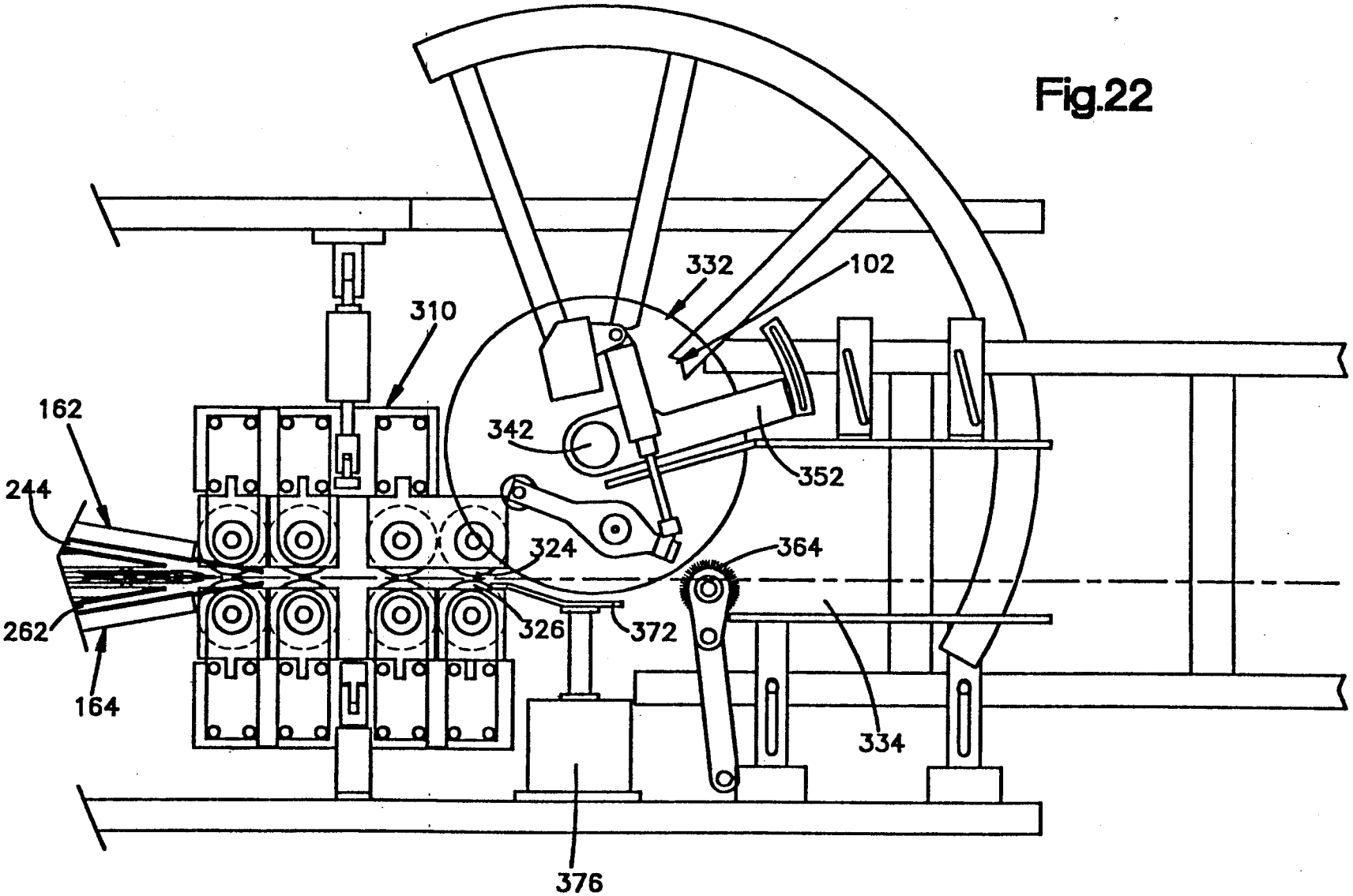
FIG. 22 is a plan view, taken generally along the line 22—22 of FIG. 21, further illustrating the relationship between the creaser roll assembly and the stacker assembly.
Figure 23:
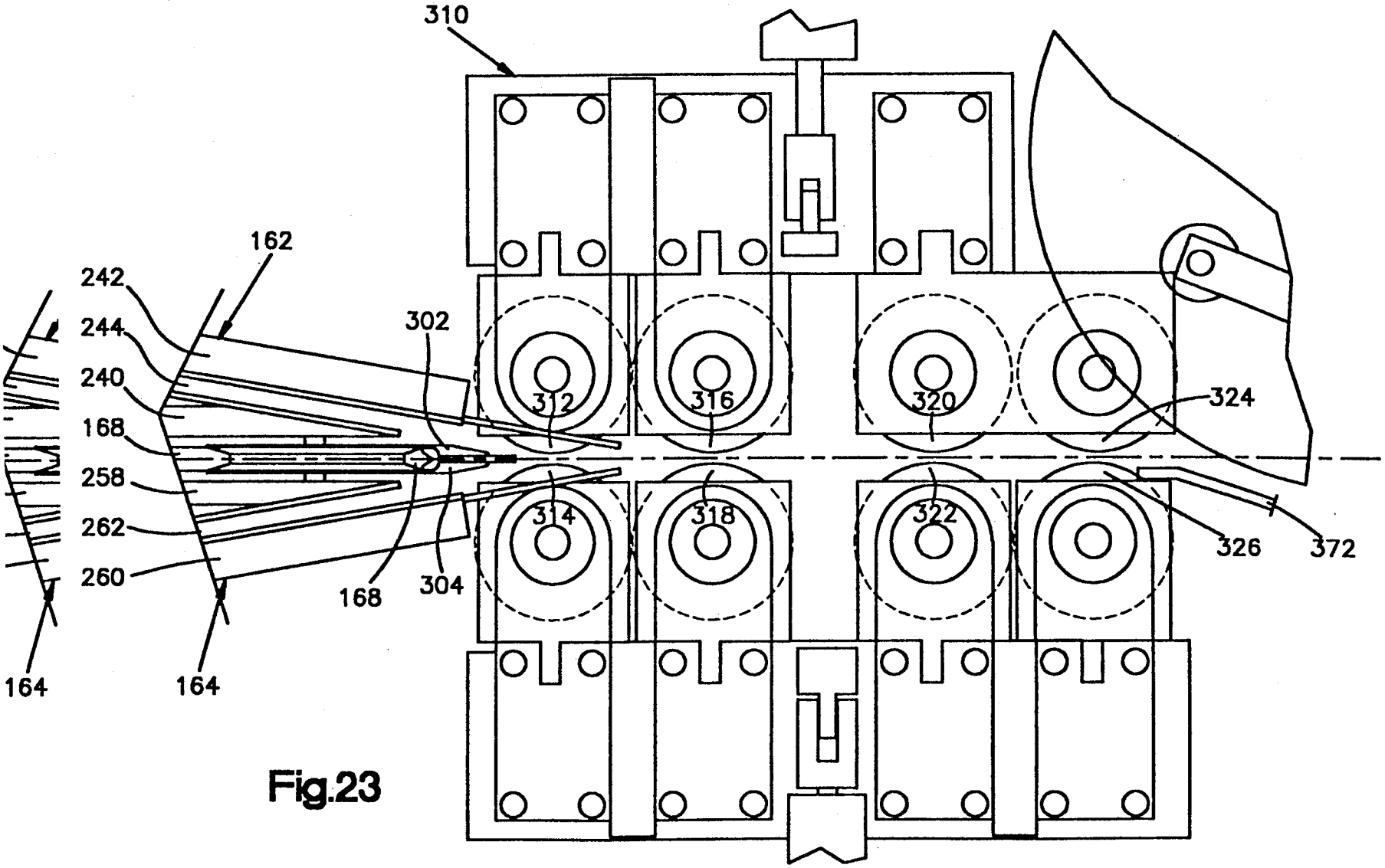
FIG. 23 is an enlarged plan view, similar to FIG. 22, further illustrating the construction of the creaser roll assembly.

As the folded signatures 48 are discharged from the third folder assembly 86, the signatures enter a creaser roll assembly 310 (FIGS. 21, 22 and 23). The creaser roll assembly 310 includes a plurality of pairs of creaser rolls which engage opposite sides of a folded signature 48 and press against the folds to crease the folds and positively form them in the signature.

A first pair of creaser rolls 312 and 314 (FIG. 20) extend through recesses formed in the outer former walls 242 and 260 and engage the signatures 48 only at a location adjacent to the folds 36 and 38 (FIG. 6). Thus, the creaser rolls 312 and 314 have a relatively short axial extent, approximately one inch, and engage each of the signatures 48 in turn only at a location adjacent to the folds 36 and 38. This is because when the leading end or folded edge 34 of a signature enters the nip between the creaser rolls 312 and 314, the fold 36 is still being formed in the trailing portion of the signature 48. Therefore, the fold 34 at the leading end of the signature does not extend precisely vertically upwardly from the fold 36. At this time, the fold 34 is skewed slightly rearwardly so that the upper end of the fold 34 slightly lags the lower end of the fold 34.

A second set of creaser rolls 316 and 318 (FIG. 23) also have a relatively short axial extent and engage the leading portion of the signatures at locations adjacent to the fold 36. By the time the leading edge or fold 34 on a signature moves into a third set of creaser rolls 320 and 322 (FIG. 23), the folds 36 and 38 will have been more fully formed. The creaser rolls 320 and 322 have an axial extent which is at least as great as the length of the signature's leading edge or fold 34. Therefore, the creaser rolls 320 and 322 are effective to press against the folds 34 and firmly crease each of the signatures 48 in turn as they move through the nip between the creaser rolls 320 and 322. At this time, the fold 34 will be almost exactly vertical since the majority of the folds 36 and 38 will have been formed.

A fourth and final set of creaser rolls 324 and 326 also have an axial length corresponding to the length of the folded leading edge 34 of a signature. The creaser rolls 312, 316, 320 and 324 may be moved either toward or away from the creaser rolls 314, 318, 322 and 326 to accommodate different signature thicknesses and/or paper thicknesses. The creaser rolls of each pair of creaser rolls are interconnected so that they both move together in a direction toward or away from the centerline along which the signatures move to thereby maintain symmetry. Thus, when the creaser roll 312 moves away from the centerline, the creaser roll 314 also moves away from the centerline. Similarly, as the creaser roll 312 moves toward the centerline, the creaser roll 314 moves toward the centerline.

In order to enable the folder assemblies 72, 78 and 86 (FIG. 10) to operate at a relatively high speed, the stacker assembly 102 stacks the signatures 48 in an on-edge orientation. Thus, the signatures 48 leave the third folder assembly 86 in an upright orientation with the folds 36 and 38 downwardly. The stacker assembly 102 stacks the signatures in a side-by-side relationship with the major side surfaces of the signatures upright and the folds 36 and 38 downward.

When the fold 36 is being formed in the third folder assembly 86, the fold 36 extends parallel to the longitudinal central axis of the third folder assembly. However, the stacker assembly 102 may stack the signatures 48 with the fold 36 in any one of a plurality of orientations extending transversely to the longitudinal central axis of the third folder assembly 86. Although the stacker assembly 102 can be operated to stack the folded signatures 48 in any orientation within a selected range of orientations, the major side surfaces of the folded signatures are always upright and disposed in abutting engagement, in the manner illustrated schematically in FIG. 8. In addition, the signatures always rest on the outer fold 36.

The stacker assembly 102 includes a fan wheel assembly 332 (FIGS. 21 and 22). The fan wheel assembly 332 receives signatures 48 as they are discharged from the folder assembly 86. The fan wheel assembly 332 moves the signatures, with the major side surfaces of the signatures in an upright orientation, to a stack of signatures disposed on an outfeed conveyor assembly 334. The fan wheel assembly 332 presses an upright major side surface of each signature in turn against a stack of signatures disposed on the outfeed conveyor assembly 334. This results in the signatures 48 being positioned on-edge in a stack or log 64 (FIG. 8) of signatures. Since the signatures 48 are delivered from the folder assembly 86 in an upright or on-edge orientation and are placed in a stack in an upright or on-edge orientation, the stacker assembly 102 can quickly stack the signatures. If the orientation of the signatures was changed, for example if the signatures were laid down to form a shingled stream of signatures, the speed at which the stacker assembly 102 could handle signatures would be impaired.

The fan wheel assembly 332 includes a plurality of slotted disks 338 (FIG. 21) which are rotated about a vertical axis 340 by a drive shaft 342. Although the disks 338 are fixedly connected with the drive shaft 342, they are spaced apart from each other by an axial distance sufficient to enable stripper fingers 346 to extend into spaces between the disks 338. The stripper fingers 346 are secured to a vertically extending support arm 350. The vertical support arm 350 is connected with horizontal mounting arm 352 (FIG. 22) which is rotatable about the central axis 340 of the shaft 342 to adjust the position of the stripper fingers 346 relative to the fan wheel disks 338.

Figure 24:
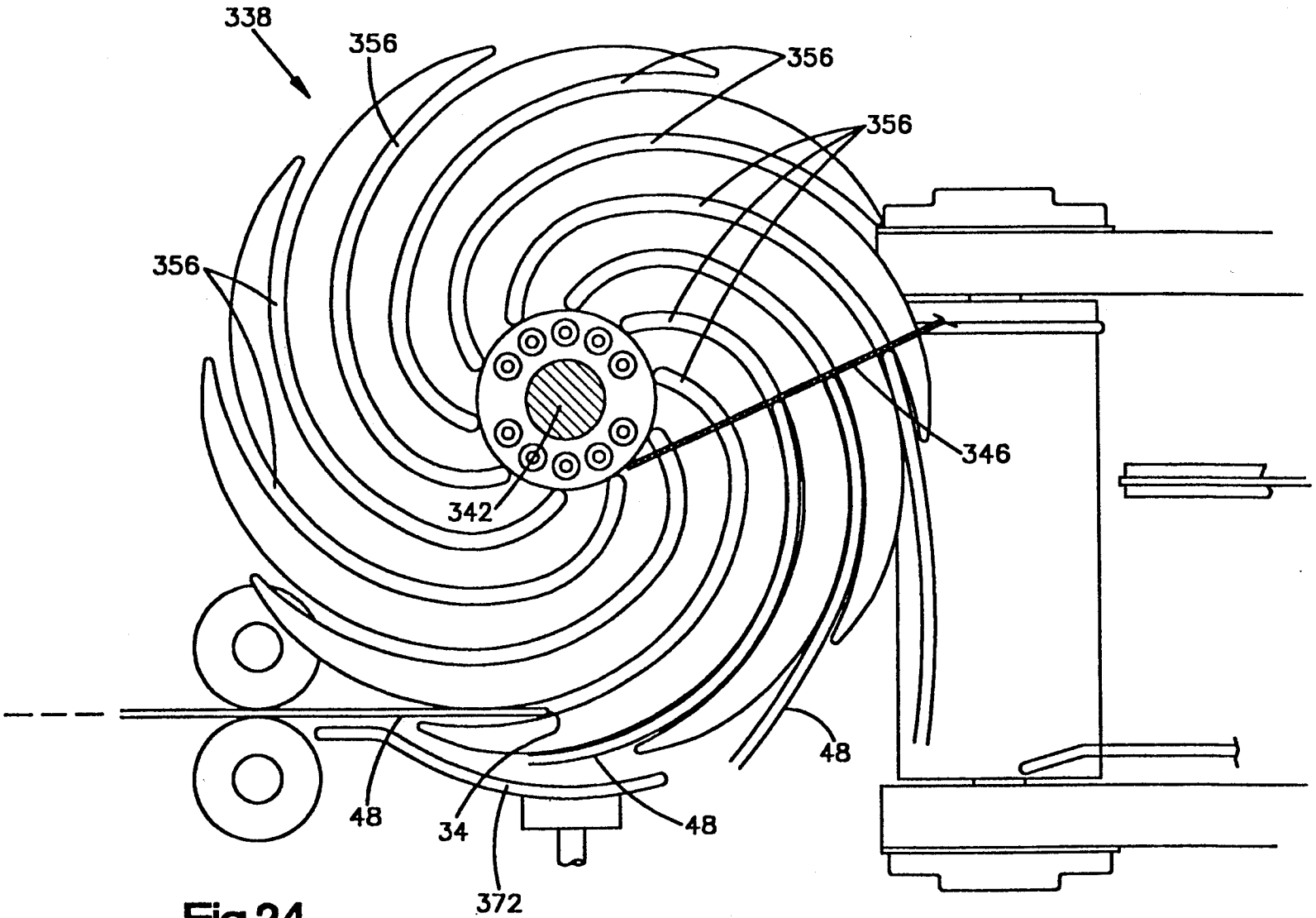
FIG. 24 is a schematic illustration of a fan wheel disk used in the stacker assembly of FIGS. 21 and 22 to stack sheet material in an on-edge or upright orientation.

Each of the fan wheel disks 338 is provided with a plurality of involute slots 356 (FIG. 24) which extend axially through the disk. The slots 356 in the disks 338 are vertically aligned to form signature receiving pockets. The slots 356 in the fan wheel disks 338 are vertically aligned with each other so that when a signature leaves the creaser roll assembly 310 (FIG. 22), the fold 34 (FIG. 6) at the leading end portion of the signatures enters a pocket formed by the vertically aligned slots in the disks 338. The fold 36, at the bottom of the signature, rests on a solid circular support plate 360 (FIG. 21). The support plate 360 is connected to the drive shaft 342 and rotates with the disks 338.

As a signature 48 is fed into a pocket formed by the slot 356 with the major side surfaces of the signature in an upright orientation, the fold 34 at the leading end of the signature moves toward the radially innermost end portion of the pocket. As this is occurring, the fan wheel assembly 338 continues to rotate in a counterclockwise direction as viewed in FIG. 24. The major side surfaces of the signature remain in the vertical orientation which they had when the signature left the third folder assembly 86.

As the fan wheel disks 338 continue to rotate, the fold 34 at the leading end of a signature 48 engages the stripper fingers 346 which are disposed between the fan wheel disks. When the leading end 34 of the signature engages the stripper fingers 346, continued rotation of the fan wheel assembly 332 in a counterclockwise direction (as viewed in FIG. 24) results in the signature being gradually forced out of the pocket. As this is occurring, the trailing end portion of the signature is engaged by a brush roller 364 (FIG. 22) and deflected toward the circumference of the fan wheel disk 338.

Continued rotation of the fan wheel disk 338 (FIG. 24) with the folded leading end portion 34 of a signature 46 in engagement with the stripper fingers 346 results in the signature being completely pushed from the pocket formed by the slot 356 and pressed against the stack of signatures by the rotating fan wheel disk. As the stack 64 of signatures increases in size, a spring biased presser arm (not shown) is moved away from the stacker assembly 102. The signatures 48 are subsequently removed from the stack 64 and bundled or otherwise processed.

A spring-biased back guard 372 (FIG. 22) is provided adjacent to the periphery of the fan wheel assembly 332 to guide movement of the signatures into the fan wheel assembly and to retain the trailing end portion of the signatures adjacent to the fan wheel assembly as they move into engagement with the brush roller 364. A jam detector switch 376 is connected with the back guard 372 and provides an output signal if signatures should become jammed against the back guard.

Although the outfeed conveyor or support table 334 has been shown as extending parallel to the longitudinal central axis of the third folder assembly 86, the outfeed conveyor could be moved relative to the fan wheel assembly 332 to cause the stack of signatures to accumulate with the longitudinal central axis of the stack of signatures skewed relative to the longitudinal central axis of the third folder assembly 86. Thus, the outfeed conveyor 334 could be displaced in a counterclockwise direction from the position shown in FIG. 22 to allow the signatures to accumulate in a direction which extends upwardly and toward the right in FIG. 22.

Former—Second Embodiment

Figure 25:
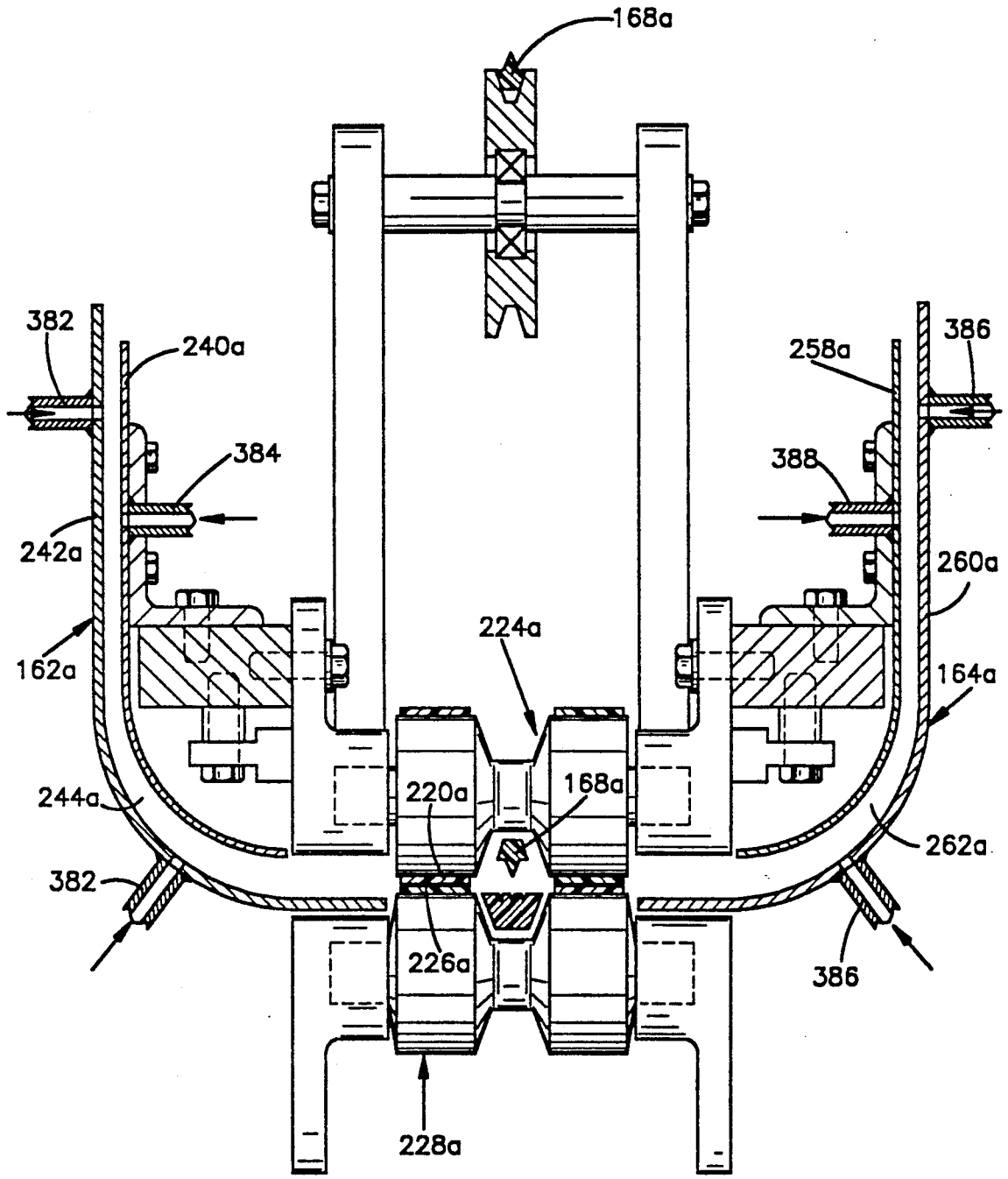
FIG. 25 is a sectional view, similar to FIG. 17, illustrating a second embodiment of the invention in which a flow of air is conducted between the inner and outer former walls of the third folder assembly to facilitate movement of sheet material between the former walls.

It is contemplated that during high speed operation of the folder assembly 86, the signatures 46 may drag on the walls of the formers 162 and 164. In the embodiment of the invention illustrated in FIG. 25, air under pressure is conducted into the space between the former walls to prevent the signatures from dragging on the former walls and to minimize friction between the signatures and the former walls. Since the embodiment of the invention illustrated in FIG. 25 is generally similar to the embodiment of the invention illustrated in FIGS. 10–24, similar numerals will be utilized to designate similar components, the suffix letter "a" being associated with the numerals in FIG. 25 to avoid confusion.

A plurality of conduits 382 are connected to the outer wall 242*a* of a former 162*a*. Similarly, a plurality of conduits 384 are connected to the inner wall 240*a* of the conduits 382 and 384 to the space 244*a* between the inner and outer walls 240*a* and 242*a* of the former 162*a*. This flow of air cushions the signature and reduces friction or drag forces between the signature and the inner side surfaces of the former walls 240*a* and 242*a*.

A plurality of conduits 386 are connected with the outer former wall 260*a*. Similarly, a plurality of conduits 388 are connected with the inner former wall 258*a*. Air conducted through the conduits 386 and 388 to the space 262*a* between the former walls 258*a* and 260*a* cushions a signature and reduces friction forces between the signature and the inner side surfaces of the former walls.

Conclusion

The present invention provides a new and improved folder apparatus 70 which is operable at a relatively high speed to form a plurality of folds 32, 34, 36 and 38 in sheet material. The folds are formed by a series of folder assemblies 72, 78 and 86 through which the sheet material continuously moves at a relatively high speed. The folded sheet material is stacked on edge by a stacker assembly 102.

The folder apparatus includes a first folder assembly 72 which forms a fold 32 extending along the path of movement of the sheet material. A second folder assembly 78 forms a fold 34 which extends transversely to the path of movement of the sheet material. Finally, a third folder assembly 86 forms folds 36 and 38 which extend along the path of movement of the sheet material. During the folding of the sheet material by the three folder assemblies 72, 78, and 86, the sheet material 48 is continuously moved through the folder assemblies without stopping.

Figure 8:
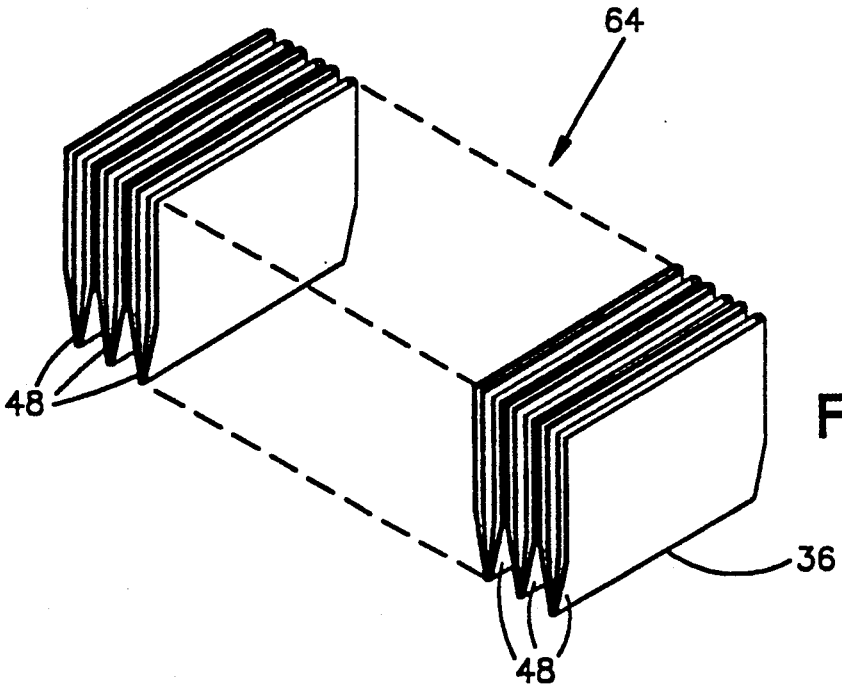
FIG. 8 is a schematic illustration depicting the manner in which the folded sheet material of FIG. 6 is stacked in an on-edge orientation.

When the sheet material 48 leaves the third folder assembly 86, the opposite major side surfaces of the sheet material are in an upright orientation. A stacker assembly 102 stacks the folded sheet material 48 with the major side surfaces in the same orientation as when the sheet material leaves the third folder assembly, that is, with the major side surfaces upright (FIG. 8).

Figure 9:
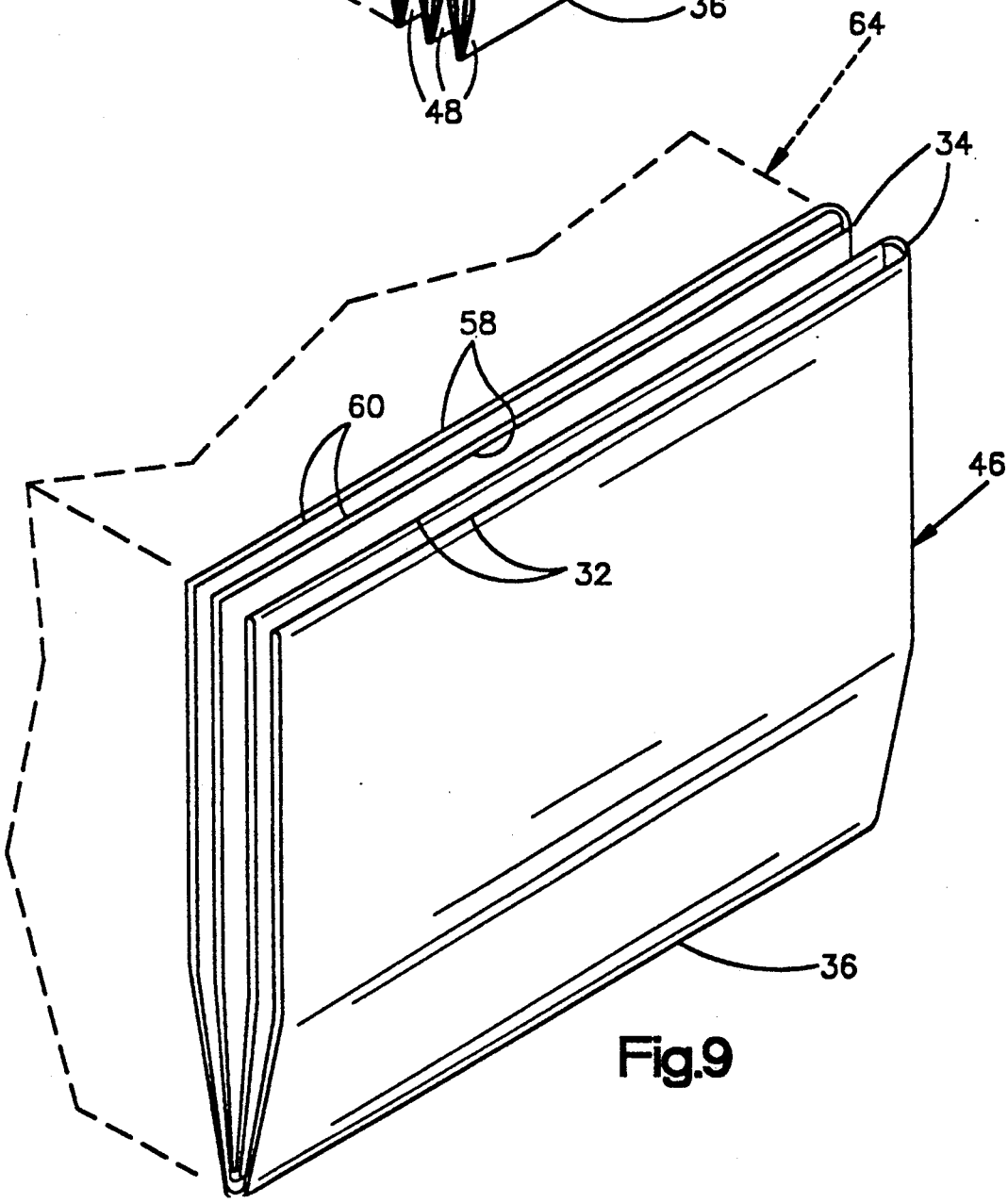
FIG. 9 is an enlarged schematic illustration depicting folded sheet material in an on-edge orientation in the stack of FIG. 8.

In the illustrated embodiments of the invention, the formers 162 and 164 deflect the signature 48 upwardly to form the folds 36 and 38 at the bottom of the signature. However, it is contemplated that the formers 162 and 164 could deflect the signature 48 downwardly, rather than upwardly. This would result in the folds 36 and 38 being at the top of the signature rather than the bottom of the signature. It is preferred to have the folds 36 and 38 at the bottom of the signature so that the stacker assembly 102 stacks the signatures on the fold 36 rather than the cut edges 58 and 60 of the signature (FIGS. 8 and 9). However, the signatures 48 could be stacked with the fold 36 upwardly if desired.

In the illustrated embodiment of the invention, the first folder assembly 72 is of a known type which uses a former board 44 to form a fold in the web 40. The second folder assembly 78 is of a known type which forms a fold due to the interaction between a tucking cylinder 52 and jaw cylinder 80. It is contemplated that, under certain conditions, it may be desirable to substitute other known types of folders for the illustrated folder assemblies 72 and 78. If this were done, it is recommended that these folders be constructed such that the sheet material moves through the folders without stopping in order to maximize production.

In the illustrated embodiment of the invention, the stacker assembly 102 stacks the signatures 48 on-edge with major side surfaces of the signatures upright. It is believed that stacking the signatures in this orientation enables the stacker assembly 102 to quickly stack signatures in order to accommodate high speed operation of the folder assemblies 72, 78 and 86. However, other known types of stacker assemblies may be used if desired.

Having described a specific preferred embodiment of the invention, the following is claimed:

1. A folder for forming a fold along a predetermined fold line is sheet material, said folder comprising upper and lower tapes disposed in an array, said array of upper and lower tapes tapering from a first width at a wide inlet portion of said folder to a second width which is smaller than the first width and which is disposed at a narrower end portion of the array at a location between the inlet and outlet portions of said folder, said upper and lower tapes having surface means for grippingly engaging upper and lower sides of the sheet material and holding the sheet material flat on opposite sides of the fold line in areas which decrease in the distance which they extend transversely outwardly from the fold line as the sheet material moves through said folder, first deflector means disposed adjacent to a first side of said array of upper and lower tapes and extending from the inlet portion of said folder to the outlet portion of said folder for deflecting sheet material extending from a flat area on a first side of the fold line in a first direction as the sheet material moves from the inlet portion to the outlet portion of said folder, said first deflector means including an inner former wall for engaging a first side of the sheet material and an outer former wall for engaging a second side of the sheet material, second deflector means disposed adjacent to a second side of said array of upper and lower tapes and extending from the inlet portion of said folder to the outlet portion of said folder for deflecting sheet material extending from a flat area on a second side of the fold line in the first direction as the sheet material moves from the inlet portion to the outlet portion of said folder, said second deflector means including an inner former wall for engaging the first side of the sheet material and an outer former wall for engaging the second side of the sheet material, said first and second deflector means including deflector surfaces disposed on said former walls for engaging areas of the sheet material which increase int he first direction as the flat area of the sheet material engaged by said array of upper and lower tapes decreases, said upper and lower tapes gripping the first and second sides of the sheet material at locations disposed between said former walls of said first and second deflector means, and drive means for moving the upper and lower tapes of said array of upper and lower tapes to feed sheet material from the inlet portion of said folder toward the outlet portion of said folder while maintaining the areas on opposite sides of the fold line flat and in the same plane.

2. A folder as set forth in claim 1 further including an upper creaser belt for engaging the sheet material along fold line at a location between tapes of said upper tapes and a lower creaser belt for engaging the sheet material along the fold line at a location between tapes of said lower tapes, said upper and lower creaser belts cooperating to form a crease in the sheet material as it moves from the wide inlet portion of said folder to the outlet portion of said folder.

3. A folder as set forth in claim 2 wherein said upper and lower creaser belts move out of engagement with the sheet material at the outlet portion of said folder, said inner former walls of said first and second deflector means extending from the inlet portion of said folder past the narrow end portion of said array of upper and lower tapes to the outlet portion of said folder, said upper and lower creaser belts extending past ends of said inner former walls of said first and second deflector means at the outlet portion of said folder, said outer former walls of said first and second deflector means extending from the inlet portion of said folder past the narrow end portion of said array of upper and lower tapes to the outlet portion of said folder, said outer former walls of said first and second deflector means extending past the ends of said inner former walls and said upper and lower creaser belts at the outlet portion of said folder.

4. A folder for forming a fold along a predetermined fold line in sheet material, said folder comprising upper and lower tapes disposed in an array, said array of upper and lower tapes tapering from a first width at a wide inlet portion of said folder to a second width which is smaller than the first width and which is disposed at a narrower end portion of the array at a location between the inlet and outlet portions of said folder, said upper and lower tapes having surface means for gripping upper and lower sides of the sheet material and holding the sheet material flat on opposite sides of the fold line in areas which decrease in the distance which they extend transversely outwardly from the fold line as the sheet material moves through said folder, said upper and lower tapes gripping the sheet material between side surfaces of said upper and lower tapes from the inlet portion of said folder to the narrow end portion of the array of upper and lower tapes, first deflector means disposed adjacent to a first side of said array of upper and lower tapes and extending from the inlet portion of said folder to the outlet portion of said folder for deflecting sheet material extending from a flat area on a first side of the fold line in a first direction as the sheet material moves from the inlet portion to the outlet portion of said folder, second deflector means disposed adjacent to a second side of said array of upper and lower tapes and extending from the inlet portion of said folder to the outlet portion of said folder for deflecting sheet material extending from a flat area on a second side of the fold line in the first direction as the sheet material moves from the inlet portion to the outlet portion of said folder, said first and second deflector means including deflector surfaces for engaging areas of the sheet material which increase in the first direction as the flat area of the sheet material engaged by said array of upper and lower tapes decreases, drive means for moving the upper and lower tapes of said array of upper and lower tapes to feed sheet material from the inlet portion of said folder toward the outlet portion of said folder while maintaining the areas on opposite sides of the fold line flat and in the same plane, and creaser means extending from the narrow end portion of said array of upper and lower tapes to the outlet portion of said folder for pressing against opposite sides of the sheet material along the fold line after the sheet material has moved out of engagement with said array of upper and lower tapes and while the sheet material is deflected by said first and second deflector means.

5. A folder as set forth in claim 4 wherein said array of upper and lower tapes includes upper tapes which engage a first side of the sheet material and lower tapes which engage a second side of the sheet material, said folder further including a blade means disposed in the outlet portion of said folder for engaging one of the sides of said sheet material, said first and second deflector means being engageable with a side of said sheet material opposite from the one side to press the one side of the sheet material against said blade means.

6. A folder for forming a fold along a predetermined fold line in sheet material, said folder comprising an array of upper and lower tapes, said array of upper and lower tapes tapering from a first width at a wide inlet portion of said folder to a second width which is smaller than the first width and which is disposed at a narrower end portion of the array at a location between the inlet and outlet portions of said folder, said array of upper and lower tapes having surface means for grippingly engaging upper and lower sides of the sheet material and holding the sheet material flat on opposite sides of the fold line in areas which decrease in the distance which they extend transversely outwardly from the fold line as the sheet material moves through said folder, said array of upper and lower tapes includes a first upper and tape and a first lower tape for grippingly engaging a portion of the flat area of the sheet material on a first side of the fold line and a second upper and a second lower tape for grippingly engaging a portion of the flat area of the sheet material on a second side of the fold line, said first and second upper and lower tapes being at least partially disposed at opposite outer edge portions of said array of upper and lower tapes and at a wide portion of said array of upper and lower tapes to grip the sheet material at portions of the flat areas which are spaced from the fold line, said first and second upper and lower tapes extending from the inlet portion of said folder to locations disposed in a first portion of said folder, said array of upper and lower tapes including a third upper tape and a third lower tape for grippingly engaging a portion of the flat area of the sheet material disposed on the first side of the fold line and closer to the fold line than the portion of the flat area of the sheet material gripped by said first upper tape and said first lower tape, said array of upper and lower tapes including a fourth upper tape and a fourth lower tape for grippingly engaging a portion of the flat area of the sheet material disposed on the second side of the fold line and closer to the fold line than the portion of the flat area of the sheet material gripped by said second upper tape and said second lower tape, said third and fourth upper and lower tapes being at least partially disposed at opposite outer edge portions of said array of upper and lower tapes and extending to locations disposed in a second portion of said folder, said second portion of said folder being disposed further from said inlet portion of said folder than said first portion of said folder, said array of upper and lower tapes including a fifth upper tape and a fifth lower tape for grippingly engaging a portion of the flat area of the sheet material disposed on the first side of the fold line and closer to the fold line than the portion of the flat area of the sheet material gripped by said third upper tape and said third lower tape, said array of upper and lower tapes including a sixth upper tape and a sixth lower tape for grippingly engaging a portion of the flat area of the sheet material disposed on the second side of the fold line and closer to the fold line than the portion of the flat area of the sheet material gripped by said fourth upper tape and said fourth lower tape, said fifth and sixth upper and lower tapes being at least partially disposed at a central portion of said array of upper and lower tapes and extending to locations disposed in a third portion of said folder, said third portion of said folder being disposed further from said inlet portion of said folder than said second portion of said folder, first deflector means disposed adjacent to a first side of said array of upper and lower tapes and extending from the inlet portion of said folder to the outlet portion of said folder for deflecting sheet material extending from a flat area on a first side of the fold line in a first direction as the sheet material moves from the inlet portion to the outlet portion of said folder, second deflector means disposed adjacent to a second side of said array of upper and lower tapes and extending from the inlet portion of said folder to the outlet portion of said folder for deflecting sheet material extending from a flat area on a second side of the fold line in the first direction as the sheet material moves from the inlet portion to the outlet portion of said folder, said first and second deflector means including deflector surfaces for engaging areas of the sheet material which increase in the first direction as the flat area of the sheet material engaged by said array of upper and lower tapes decreases, drive means for moving the upper and lower tapes of said array of upper and lower tapes to feed sheet material from the inlet portion of said folder toward the outlet portion of said folder while maintaining the areas on opposite sides of the fold line flat and in the same plane, and an upper creaser belt and a lower creaser belt for creasing the sheet material along the fold line, said upper and lower creaser belts being at least partially disposed between the third portion of said folder and the outlet portion of said folder to grip the sheet material along the fold line after the sheet material has moved out of the grip of said fifth and sixth upper and lower tapes.

7. A folder as set forth in claim 6 wherein at least portions of said upper and lower creaser belts engage the sheet material along the fold line at locations between said first and second upper and lower tapes.

8. A folder for forming a fold along a predetermined fold line in sheet material, said folder comprising an array of upper and lower tapes, said array of upper and lower tapes tapering from a first width at a wide inlet portion of said folder to a second width which is smaller than the first width and which is disposed at a narrower end portion of the array at a location between the inlet and outlet portions of said folder, said array of upper and lower tapes having surface means for gripping upper and lower sides of the sheet material and holding the sheet material flat on opposite sides of the fold line in areas which decrease in the distance which they extend transversely outwardly from the fold line as the sheet material moves through said folder, first deflector means disposed adjacent to a first side of said array of upper and lower tapes and extending from the inlet portion of said folder to the outlet portion of said folder for deflecting sheet material extending from a flat area on a first side of the fold line in a first direction as the sheet material moves from the inlet portion to the outlet portion of said folder, second deflector means disposed adjacent to a second side of said array of upper and lower tapes and extending from the inlet portion of said folder to the outlet portion of said folder for deflecting sheet material extending from a flat area on a second side of the fold line in the first direction as the sheet material moves from the inlet portion to the outlet portion of said folder, said first and second deflector means including deflector surfaces for engaging areas of the sheet material which increase in the first direction as the flat area of the sheet material engaged by said array of upper and lower tapes decreases, and drive means for moving the upper and lower tapes of said array of upper and lower tapes to feed sheet material from the inlet portion of said folder toward the outlet portion of said folder while maintaining the areas on opposite sides of the fold line flat and in the same plane, and blade means disposed in the outlet portion of said folder, said blade means having opposite side surfaces for engaging one of the sides of said sheet material, said deflector surfaces of said first and second deflector means extending from the inlet portion of said folder past the narrow end portion of said array of upper and lower tapes to the outlet portion of said folder and being engageable with a side of said sheet material opposite from the one side to press the one side of the sheet material against said opposite side surfaces of said blade means.

9. A folder as set forth in claim 8 further including creaser means extending from the narrow end portion of said array of upper and lower tapes to the outlet portion of said folder for pressing against opposite sides of the sheet material along the fold line after the sheet material has moved out of engagement with said array of upper and lower tapes and while the sheet material is deflected by said first and second deflector means.

10. A folder as set forth in claim 8 further including creaser means extending from the narrow end portion of said array of upper and lower tapes to the outlet portion of said folder for pressing against opposite sides of the sheet material along the fold line after the sheet material has moved out of engagement with said array of upper and lower tapes and while the sheet material is deflected by said first and second deflector means.

11. A folder as set forth in claim 8 wherein said first deflector means includes an inner former wall which extends from the inlet portion of said folder past the narrow end portion of said array of upper and lower tapes to said blade means and an outer former wall which extends from the inlet portion of said folder past the narrow end portion of said array of upper and lower tapes and past said blade means, said deflector surface of said first deflector means being disposed on said outer former wall and extending past said blade means, said second deflector means including an inner former wall which extends from the inlet portion of said folder pas the narrow end portion of said array of upper and lower tapes to said blade means and an outer former wall which extends from the inlet portion of said folder past the narrow end portion of said array of upper and lower tapes and pas said blade means, said deflector surface of said second deflector means being disposed on said outer former wall of said second deflector means and extending past said blade means.

* * * * *

UNITED STATES PATENT AND TRADEMARK OFFICE

CERTIFICATE OF CORRECTION

PATENT NO. : 5,037,368

DATED : August 6, 1991

INVENTOR(S) : Richard Edward Breton, et al.

It is certified that error appears in the above-identified patent and that said Letters Patent is hereby corrected as shown below:

Column 16, Lines 3 and 4, Claim 1, delete "int he" and insert --in the--.

Column 17, Line 46, Claim 6, delete "and" (second occurrence).

Column 20, Line 31, Claim 11, change "pas" to --past--.

Line 36, change "pas" to --past--.

Signed and Sealed this

First Day of December, 1992

*Attest:*

*Attesting Officer*

DOUGLAS B. COMER

*Acting Commissioner of Patents and Trademarks*